US009539599B2

(12) United States Patent
Crawford

(10) Patent No.: US 9,539,599 B2
(45) Date of Patent: Jan. 10, 2017

(54) RECIRCULATION BLOCK

(71) Applicant: Millennium Custom Coatings, Inc., Indianapolis, IN (US)

(72) Inventor: Robert G. Crawford, Brownsburg, IN (US)

(73) Assignee: Millennium Custom Coatings, Inc., Indianapolis, IN (US)

( * ) Notice: Subject to any disclaimer, the term of this patent is extended or adjusted under 35 U.S.C. 154(b) by 145 days.

(21) Appl. No.: 14/527,838

(22) Filed: Oct. 30, 2014

(65) Prior Publication Data

US 2015/0114494 A1 Apr. 30, 2015

Related U.S. Application Data

(60) Provisional application No. 61/898,163, filed on Oct. 31, 2013.

(51) Int. Cl.

| | |
|---|---|
| ***B05B 12/14*** | (2006.01) |
| ***B05B 7/04*** | (2006.01) |
| ***B05B 7/16*** | (2006.01) |
| ***B05B 7/24*** | (2006.01) |

(52) U.S. Cl.

CPC ..... *B05B 12/1418* (2013.01); *B05B 7/0408* (2013.01); *B05B 7/1613* (2013.01); *B05B 7/24* (2013.01); *Y10T 137/85954* (2015.04)

(58) Field of Classification Search

CPC .. B05B 12/1418; B05B 7/0408; B05B 7/1613; B05B 7/24; Y10T 137/85954

See application file for complete search history.

(56) References Cited

U.S. PATENT DOCUMENTS 5,388,767 A * 2/1995 Moses ..... B05B 7/0408 239/411
7,849,879 B2 * 12/2010 Rauch et al. ..... B05B 7/1404 118/312
8,652,581 B2 * 2/2014 Merchant ..... B05B 5/025 427/426

OTHER PUBLICATIONS

GlasCraft, Probler $P_2$ Dispense Gun User Manual, Aug. 2012.

(Continued)

*Primary Examiner* — Kevin Lee
(74) *Attorney, Agent, or Firm* — Frost Brown Todd LLC

(57) ABSTRACT

A recirculation block includes a top face and a bottom face that are connected by a right side face, a left side face, a front face, and a rear face. The recirculation block further includes a pair of junction block entry ports and a pair of side block entry ports. Both of the junction block entry ports are positioned on the bottom face. The first side block entry port is positioned on the right side face and the second side block entry port is positioned on the left side face. The recirculation block further includes a pair of exit ports. The first exit port is in fluid communication with both the first junction block entry port and the first side block entry port. The second exit port is in fluid communication with both the second junction block entry port and the second side block entry port.

20 Claims, 21 Drawing Sheets

(56) References Cited

OTHER PUBLICATIONS

Graco, 246362 Circulation Manifold Kit: For Fusion™ Spray Gun, Instruction Manual, Sep. 2003.
Graco, Reactor: Hydraulic, Heated, Plural Component Proportioner, Operation Manual, Dec. 2012.
Madison Chemical Industries, Inc., Plural Component Coating Application Equipment: Basic Configuration Description, Mar. 2010.
MCC Equipment & Service Center, Schematic of KIT, RECIRC BLOCK, CHECK VALVE, P2, Part No. 30106-00, Jan. 17, 2012.
MCC Equipment & Service Center, Statement of Sale of Part No. 30106-00, identified in the schematic dated Jan. 17, 2012.

* cited by examiner

RECIRCULATION BLOCK

REFERENCE TO RELATED APPLICATION

This application claims priority to U.S. Provisional Patent Application Ser. No. 61/898,163, entitled "Recirculation Block," filed Oct. 31, 2013, the disclosure of which is incorporated by reference herein.

BACKGROUND

Plural component materials are typically applied using a spray system. Typical examples of plural components include but are not limited to epoxies, paints, urethane- and polyurea-based coatings, and urethane-based pour and spray foams. Plural component materials typically include a first fluid component and a second fluid component. By way of example only, the first fluid component and the second fluid component may respectively comprise a resin and a hardener, a resin and an activator, or an amine and an isocyanate.

As shown in FIGS. 1-3, a conventional spray system, such as spray systems 10 and 10', typically includes a pair of storage tanks 20*a* and 20*b*, a proportioner 30, and a spray gun 40 that includes a spray gun manifold 50. As shown in FIGS. 1-3, each of the pair of storage tanks 20*a*, 20*b* is connected to the proportioner 30 via a respective one of a pair of proportioner supply lines 22*a*, 22*b* that allow the fluid components to flow separately from the respective storage tank 20*a*, 20*b* to the proportioner 30. Each storage tank 20*a*, 20*b* also includes a feed pump 26*a*, 26*b* configured to pump the fluid components from their respective storage tank 20*a*, 20*b* to the proportioner 30 through the corresponding proportioner supply line 22*a*, 22*b*. In addition, in the illustrated systems 10, 10', the proportioner 30 is connected to the spray gun 40 via the spray gun manifold 50 with a heated hose 60, which allows the fluid components to flow separately from the proportioner 30 through the spray gun manifold 50 and, ultimately, to the spray gun 40, where the individual fluid components are mixed in an inner mixing chamber in the spray gun and delivered through the nozzle of the spray gun 40. The heated hose 60 typically comprises a pair of heated gun supply hoses 62*a*, 62*b* connected to a corresponding pair of heated whip hoses 64*a*, 64*b* via a fluid temperature sensor 66. As shown in FIGS. 2 and 3, the fluid temperature sensor 66 and adjacent sections of heated gun supply hoses 62*a*, 62*b* and heated whip hoses 64*a*, 64*b* are exposed for illustration purposes. The fluid temperature sensor 66 and adjacent hoses are typically wrapped in thermal tape during normal operation of spray system 10, 10'. The illustrated spray systems 10 and 10' also include a gun air supply hose 51 configured to supply pressurized air from the proportioner 30 to the spray gun 50.

Spray system 10 shown in FIGS. 1 and 2 also includes a pair of circulation lines 24*a*, 24*b* between the proportioner 30 and a respective storage tank 20*a*, 20*b*. The proportioner 30 includes an operational setting configured to separately circulate the fluid components through the proportioner 30 and back into their respective storage tank 20*a*, 20*b*. While such an operational setting is active, the fluid components flow separately through the respective fluid supply line 22*a*, 22*b*, continue through the proportioner 30 and return to their respective storage tanks 20*a*, 20*b* via the circulation lines 24*a*, 24*b*. Spray system 10' shown in FIG. 3 is identical to spray system 10 shown in FIGS. 1 and 2, except that spray system 10' does not include circulation lines 24*a*, 24*b*. In other words, spray system 10 represents a typical spray system with circulation, while spray system 10' represents a typical spray system without circulation.

FIGS. 4-8 depict two types of conventional spray guns 140, 240 and their corresponding spray gun manifolds 150, 250. Spray gun 40 and spray gun manifold 50 shown in FIGS. 1-3 may comprise any type of suitable spray gun and spray gun manifold. For example, spray gun 50 may comprise a spray gun configured to work in conjunction with a spray gun manifold comprising a single junction block, such as junction block spray gun 140 and junction block spray gun manifold 150 shown in FIGS. 4-5. One commercial example of this type of junction block spray gun is the Fusion Air Purge spray gun made by Graco Inc. Junction block spray gun 140 includes an air hose coupling 157 configured to allow a user to attach an air hose, such as gun air supply hose 51, to the junction block spray gun 140 in order to provide pressurized air to the junction block spray gun 140. In another example, spray gun 50 may comprise a spray gun configured to work in conjunction with a spray gun manifold comprising two individual side blocks, such as side block spray gun 240 and side block spray gun manifold 250 shown in FIGS. 6-8.

As shown, the junction block spray gun manifold 150 comprises a single junction block 152 that includes a first hose coupling 154*a* and a second hose coupling 154*b*. In FIG. 5, whip hose 64*a* is connected to first hose coupling 154*a* and whip hose 64*b* is connected to second hose coupling 154*b*. Junction block 152 also includes a first manifold valve 156*a* associated with the first hose coupling 154*a* and a second manifold valve 156*b* associated with second hose coupling 154*b*. First manifold valve 156*a* may be configured to selectively open and close to either allow the respective fluid component to flow from whip hose 64*a* through junction block 152 and into the inner mixing chamber of junction block spray gun 140 or prevent delivery of the fluid component into the inner mixing chamber of junction block spray gun 140. Similarly, second manifold valve 156*b* may be configured to selectively open and close to either allow the respective fluid component to flow from whip hose 64*b* through junction block 152 and into the inner mixing chamber of the junction block spray gun 140 or prevent delivery of the fluid component into the inner mixing chamber of the junction block spray gun 140.

In this embodiment, first hose coupling 154*a* comprises a female coupling 155*a* configured to receive a corresponding male coupling 65*a* on the end of one of the pair of whip hoses 64*a*, 64*b*. Similarly, second hose coupling 154*b* comprises a female coupling 155*b* configured to receive a corresponding male coupling 65*b* on the end of the other one of the pair of whip hoses 64*a*, 64*b*. As shown in FIG. 5, junction block 152 further comprises a pair of gun couplings 158*a*, 158*b* configured to connect junction block 152 to the junction block spray gun 140 and provide communication between the junction block spray gun manifold 150 and the inner mixing chamber of the junction block spray gun 140. Each gun coupling 158*a*, 158*b* may have a smooth metal finish and a fluid port that is centered within the respective gun coupling 158*a*, 158*b*. The fluid port in junction block spray gun 140 that each gun coupling 158*a*, 158*b* is connected to may include an o-ring to provide an adequate seal between junction block 152 and junction block spray gun 140. The junction block 152 may be attached to the junction block spray gun 140 using any suitable fastener 160, including but not limited to a conventional fastener, such as the pin shown in FIG. 5, or any other fastening means or method that provides an adequate connection between the junction block 152 and the junction block spray gun 140.

FIGS. 6-8 depict an alternate type of spray gun and gun manifold. Specifically, as shown in FIGS. 6-8, side block spray gun 240 is configured to work in conjunction with a side block spray gun manifold 250 comprising two individual side blocks 252*a*, 252*b*. One commercial example of this type of side block spray gun is the Probler P2 spray gun made by Graco Inc. Side block spray gun 240 includes an air hose coupling 257 configured to allow a user to attach an air hose, such as gun air supply hose 51, to the side block spray gun 240 in order to provide pressurized air to the side block spray gun 240.

In the illustrated embodiment, the side blocks 252*a*, 252*b* are configured to mount onto either side of the side block spray gun 240 and each side block 252*a*, 252*b* includes a union fitting 254*a*, 254*b*. Each side block 252*a*, 252*b* also includes a manifold valve 256*a*, 256*b* associated with the respective union fitting 254*a*, 254*b*. Each manifold valve 256*a*, 256*b* may be configured to selectively open and close to either allow the respective fluid component to flow from the connected hose, such as whip hose 64*a*, 64*b*, through the respective side block 252*a*, 252*b* and into the inner mixing chamber of the side block spray gun 240 or prevent delivery of the fluid component into the inner mixing chamber of the side block spray gun 240. In this embodiment, each side block 252*a*, 252*b* further comprises a female hose coupling 255*a*, 255*b* configured to receive a corresponding male hose coupling, such as male coupling 65*a*, 65*b* shown in FIG. 5, on the end of one of the pair of whip hoses 64*a*, 64*b*.

Each side block 252*a*, 252*b* also includes a gun coupling configured to connect the respective side block 252*a*, 252*b* to the side block spray gun 240 and provide communication between each side block 252*a*, 252*b* and the inner mixing chamber of the side block spray gun 240. Gun coupling 258*b* on side block 252*b* is illustrated in FIG. 8. The corresponding gun coupling on side block 252*a* is not shown, but it is substantially identical to gun coupling 258*b*. As illustrated in FIG. 8, side blocks 252*a*, 252*b* are attached to side block spray gun 240 using one or more suitable fasteners 260, including but not limited to a conventional fastener, such as a screw or pin, or any other fastening means or method that provides an adequate connection between the side blocks 252*a*, 252*b* and the side block spray gun 240.

In some circumstances, it may be desirable to recirculate the individual fluid components through at least a portion of the system without mixing and discharging them through the spray gun. For example, circulating the fluid components may help prevent debris from clogging up hoses, ports, and couplings located throughout the spray system. Recirculating the fluid components may also help maintain or improve the quality of the fluid components by causing fillers contained within the fluid components to be re-suspended within the fluid instead of settling within the storage tanks, the proportioner, or the hoses. In addition, circulating the individual fluid components may also allow the user to preheat the fluid components before they are mixed and sprayed, which may result in an improved application. Recirculating fluid components through the system may be done as a part of the regular maintenance for the components of the spray system in order to maintain or improve the performance and lifespan of the various components.

As described above, some spray systems, such as spray system 10 shown in FIG. 2, include circulation lines 24*a*, 24*b* between the storage tanks 20*a*, 20*b* and the proportioner 30 that allow the user to recirculate fluid components from the storage tanks 20*a*, 20*b*, through the proportioner 30 and back into the storage tanks 20*a*, 20*b*. While helpful to an extent, this limited recirculation does not provide the same benefits as recirculating the fluid components through the entire system. Specifically, when the recirculation is limited to the circuit between the storage tanks 20*a*, 20*b* and the proportioner 30, any fluid components located in the system components downstream of the proportioner (e.g., heated hose 60, whip hoses 64*a*, 64*b*, and spray gun manifold 50) are not recirculated. As a result, any such fluid components are not preheated, the fillers are not re-suspended in those fluid components, and debris is not removed from the system components and the associated couplings and ports.

In some systems, heated hose 60 may comprise about 400 or more feet of hose, so there can be a substantial amount of fluid components located within the heated hose 60. Therefore, it may be beneficial to recirculate the fluid components throughout the entire spray system. One way to recirculate the fluid components throughout the entire spray system is to use a recirculation block. In its simplest form, a recirculation block may include an entry port (or set of entry ports) configured to connect to spray gun manifold 50 to receive fluid components and an exit port (or set of exit ports) configured to connect to one or more return hoses that lead back to storage tanks 20*a*, 20*b*, such as circulation lines 24*a*, 24*b*.

FIG. 9 depicts spray system 310, which is identical to spray system 10 of FIG. 1, except that spray gun 40 has been replaced with a recirculation block 300. Incorporating recirculation block 300 into spray system 310 results in a complete circuit that allows the user to recirculate the fluid components through the entire spray system 310. In the illustrated embodiment, the fluid components flow from storage tanks 20*a*, 20*b* to proportioner 30 through proportioner supply lines 22*a*, 22*b*. After passing through proportioner 30, the fluid components then flow to spray gun manifold 50 via heated hose 60, fluid temperature sensor 66 and whip hoses 64*a*, 64*b*. Finally, the fluid components flow from spray gun manifold 50, through recirculation block 300 and return to storage tanks 20*a*, 20*b* via circulation lines 24*a*, 24*b*, thereby completing the circuit. The arrows in FIG. 9 indicate the direction of the flow of fluid components through spray system 310.

FIG. 10 depicts an example of a prior art recirculation block 400, such as a Part 15B853 Circulation Manifold made by Graco Inc., which is part of a 246362 Circulation Manifold Kit also made by Graco Inc. Recirculation block 400 is configured to be used in conjunction with a junction block spray gun and a corresponding spray gun manifold comprising a single junction block, such as junction block spray gun 140 and junction block spray gun manifold 150 shown in FIGS. 4 and 5 and described above. In the illustrated embodiment, recirculation block 400 only includes a single pair of entry ports 402*a*, 402*b* that are configured to connect with a spray gun manifold comprising a single junction block, such as junction block spray gun manifold 150. Specifically, as shown, entry ports 402*a*, 402*b* are configured to connect to gun couplings 158*a*, 158*b* of junction block spray gun manifold 150 to allow fluid components to flow from whip hoses 64*a*, 64*b* through junction block spray gun manifold 150 and into recirculation block 400. As shown in FIG. 10, recirculation block 400 further comprises a pair of exit ports that are configured to connect with a pair of return hoses, such as circulation lines 24*a*, 24*b*. By way of example only, the return hoses may lead back to the tank of origin, such as storage tanks 20*a*, 20*b*, or to an independent tank for separate storage. Recirculation block 400 also includes a plurality of mounting apertures 401 that are configured to allow recirculation block 400 to be attached to a mounting surface or structure. Mounting apertures 401 are not in fluid communication with entry ports 402*a*, 402*b* or the pair of exit ports.

It will be appreciated that recirculation block 400 is not configured to be used in conjunction with a side block spray gun and a corresponding spray gun manifold comprising a pair of side blocks, such as side block spray gun 240 and side block spray gun manifold 250. Accordingly, it may be beneficial to provide a single recirculation block that is configured to be used with both a junction block spray gun and a side block spray gun and their respective spray gun manifolds.

While a variety of recirculation blocks have been made and used, it is believed that no one prior to the inventor(s) has made or used an invention as described herein.

BRIEF DESCRIPTION OF THE DRAWINGS

It is believed the present invention will be better understood from the following description of certain examples taken in conjunction with the accompanying drawings, in which like reference numerals identify the same elements and in which.

Figure 1:
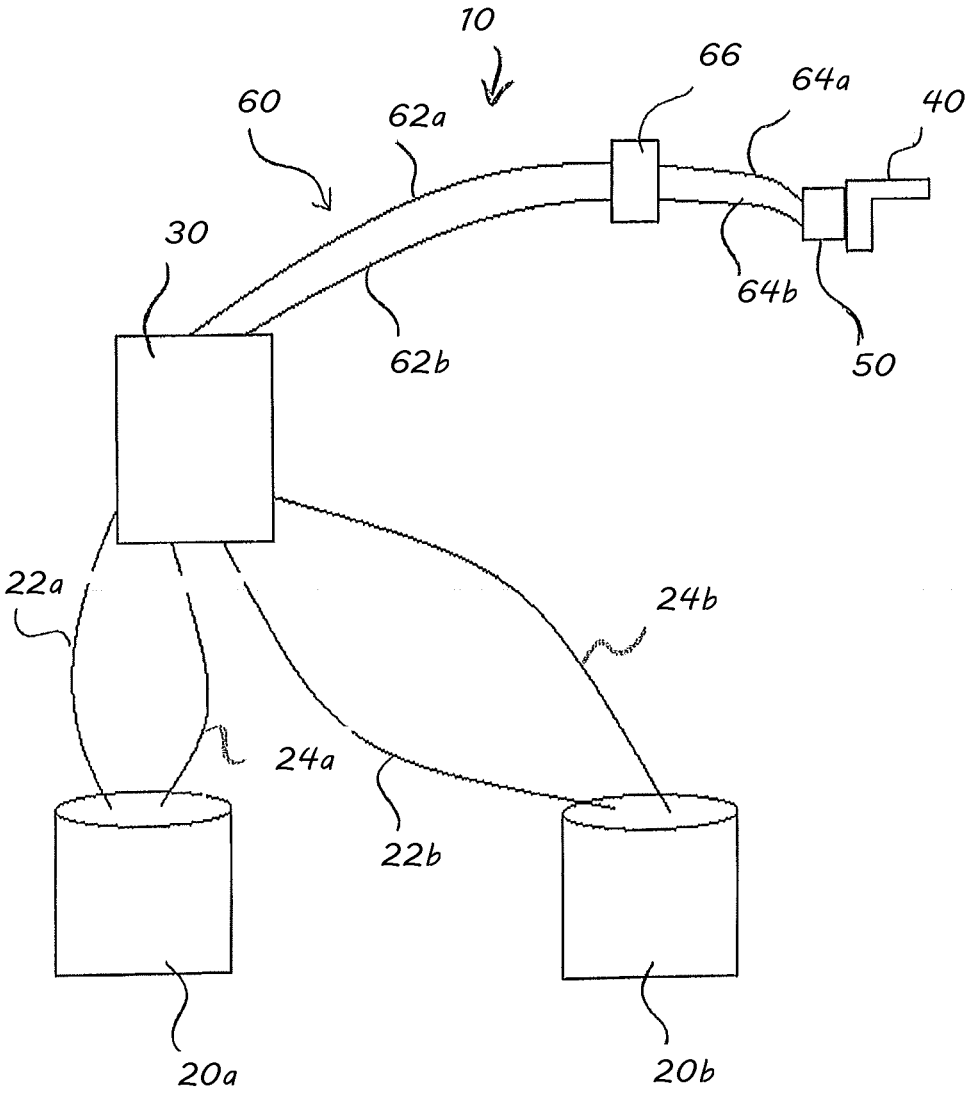
FIG. 1 (PRIOR ART)
FIG. 1 depicts a block diagram of an exemplary prior art spray system that includes circulation lines.
Figure 2:
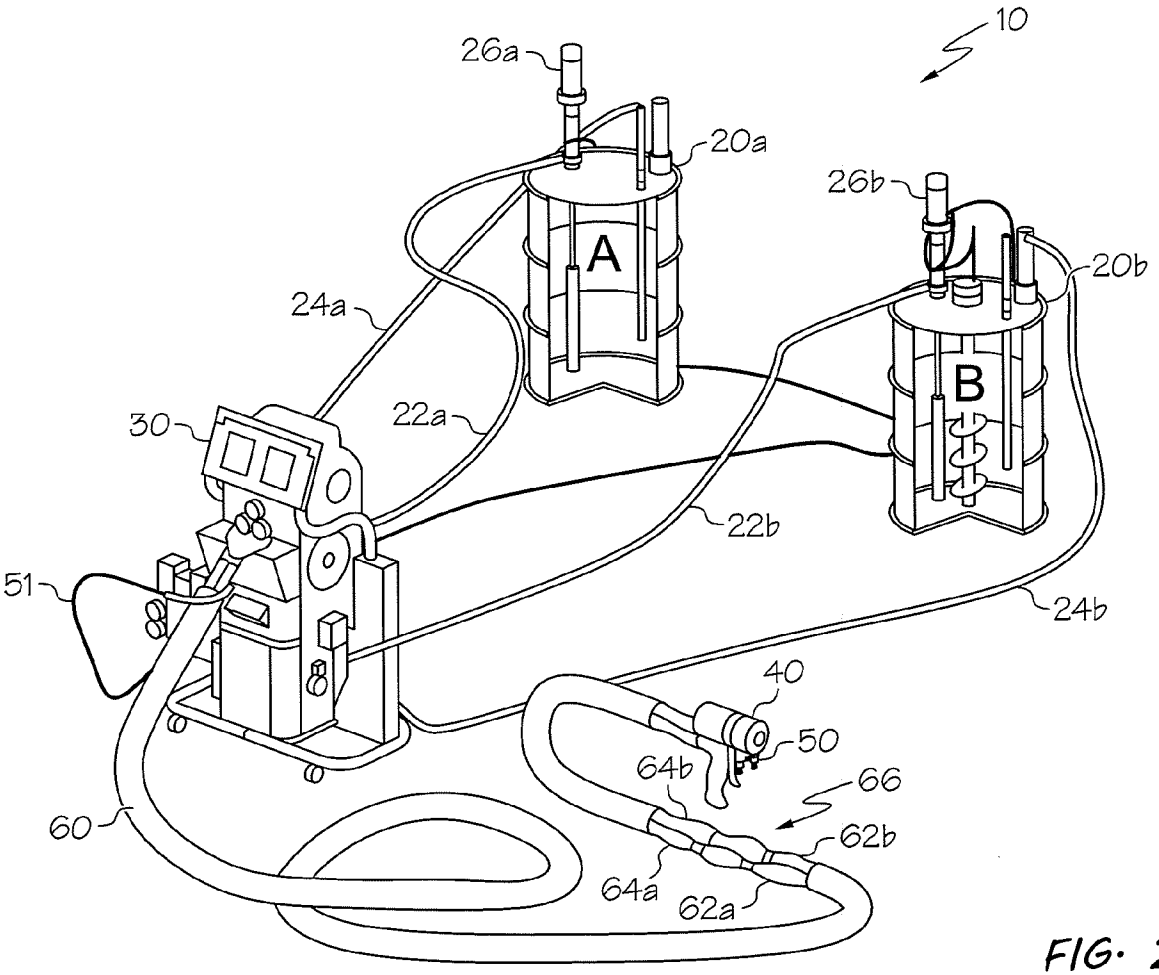
FIG. 2 (PRIOR ART)
FIG. 2 depicts a perspective view of the spray system of FIG. 1.
Figure 3:
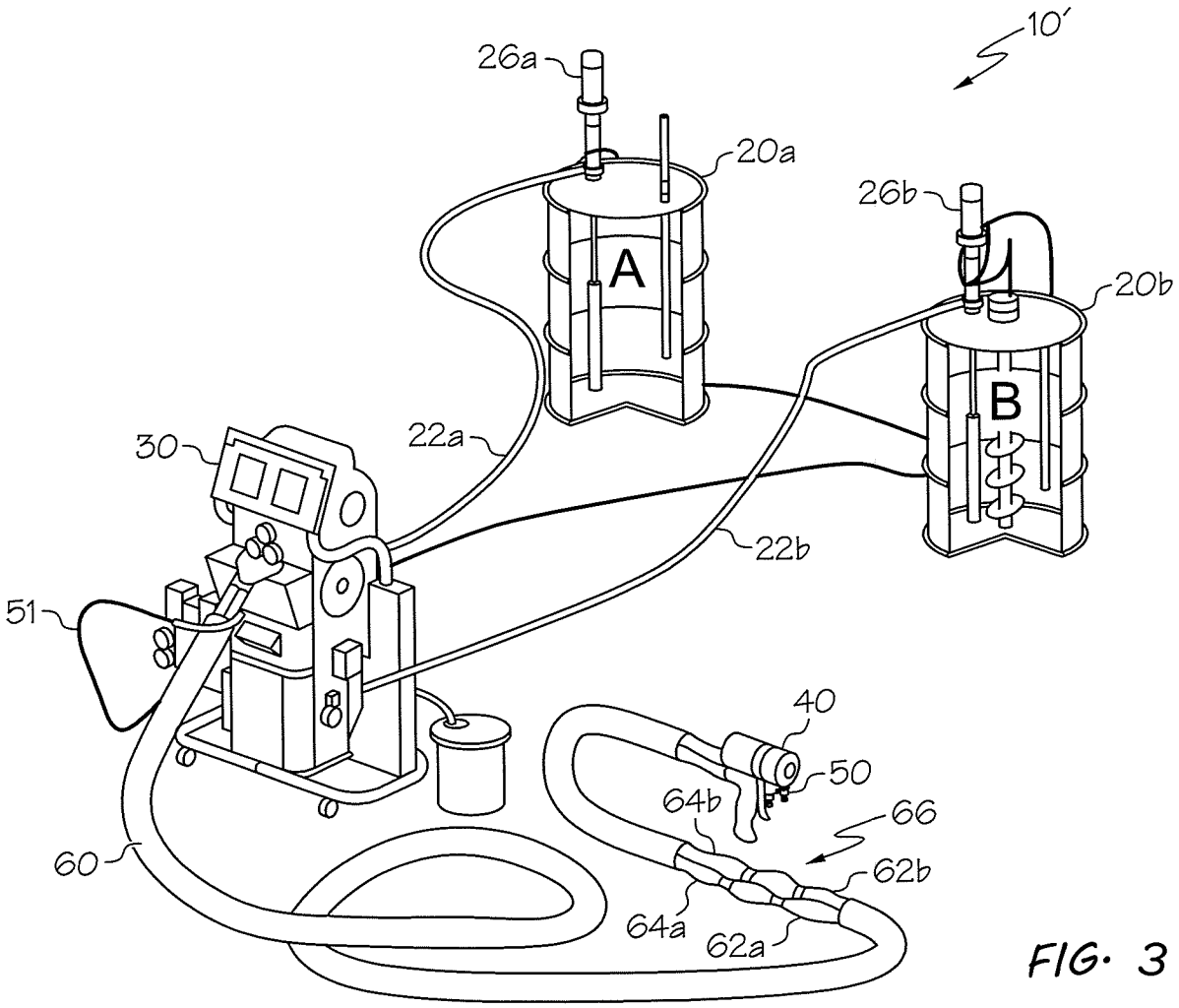
FIG. 3 (PRIOR ART)
FIG. 3 depicts a perspective view of an exemplary prior art spray system similar to the system in FIGS. 1 and 2, but without circulation lines.
Figure 4:
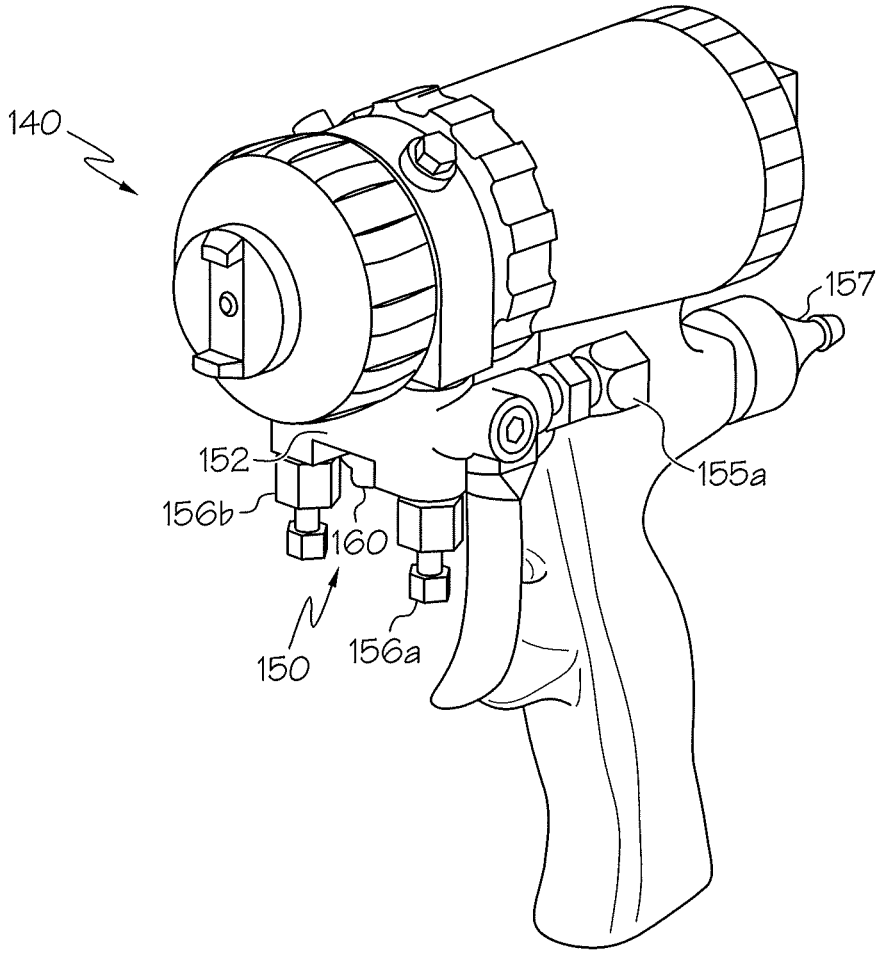
FIG. 4 (PRIOR ART)
FIG. 4 depicts a front perspective view of an exemplary prior art junction block spray gun and an exemplary prior art junction block spray gun manifold.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

It will be appreciated that, for convenience and clarity, spatial terms such as "top" "bottom", "front", "rear", "left" and "right" are used herein with respect to one exemplary method of installing a recirculation block in the field. However, recirculation blocks can be used and installed in many orientations and positions, and these terms are not intended to be limiting and absolute.

FIGS. 11-15 illustrate an exemplary recirculation block 500 that is configured to be used with both a junction block spray gun and a side block spray gun and their respective spray gun manifolds. As shown, recirculation block 500 comprises a top face 502*a* and a bottom face 502*b* that are connected by a right side face 504*a*, a left side face 504*b*, a front face 506*a*, and a rear face 506*b*. Recirculation block 500 includes a pair of lubrication apertures 503*a*, 503*b* positioned on top face 502*a* that are configured to receive any suitable lube fittings 513*a*, 513*b* configured to allow a user to feed a lubricant into the internal structures and components of recirculation block 500 by using a grease gun, including but not limited to zerk fittings. In addition to allowing a user to lubricate internal structures, including but not limited to port seals 522*a*, 522*b*, 532*a*, 532*b* and internal check valves 560*a*, 560*b*, lube fittings 513*a*, 513*b* may also be used to help flush out old fluid components from the internal structures of recirculation block 500.

In this embodiment, recirculation block 500 also includes a pair of junction block entry ports 520*a*, 520*b* positioned on the bottom face 502*b* that are configured to be connected to a junction block spray gun manifold (as described below).

Figure 5:
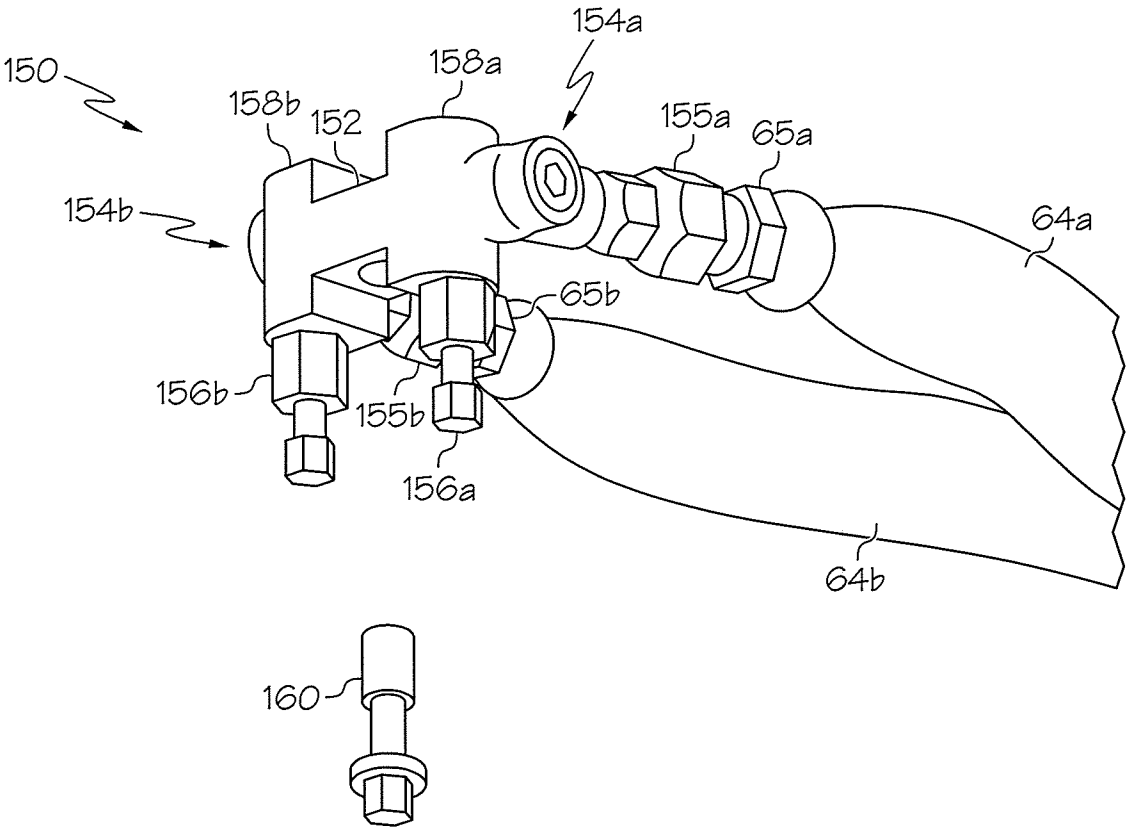
FIG. 5 (PRIOR ART)
FIG. 5 depicts a front perspective view of the exemplary junction block spray gun manifold of FIG. 4.
Figure 6:
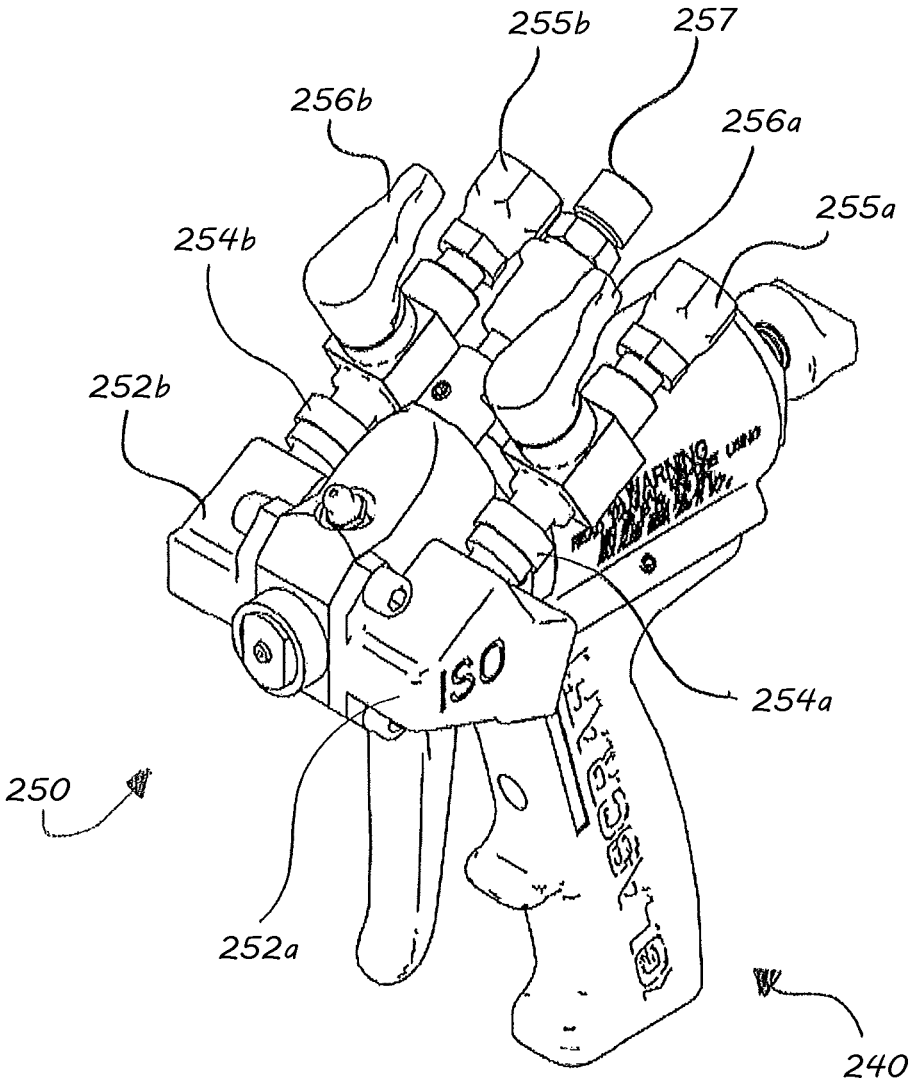
FIG. 6 (PRIOR ART)
FIG. 6 depicts a front perspective view of an exemplary prior art side block spray gun and an exemplary prior art side block spray gun manifold.
Figure 7:
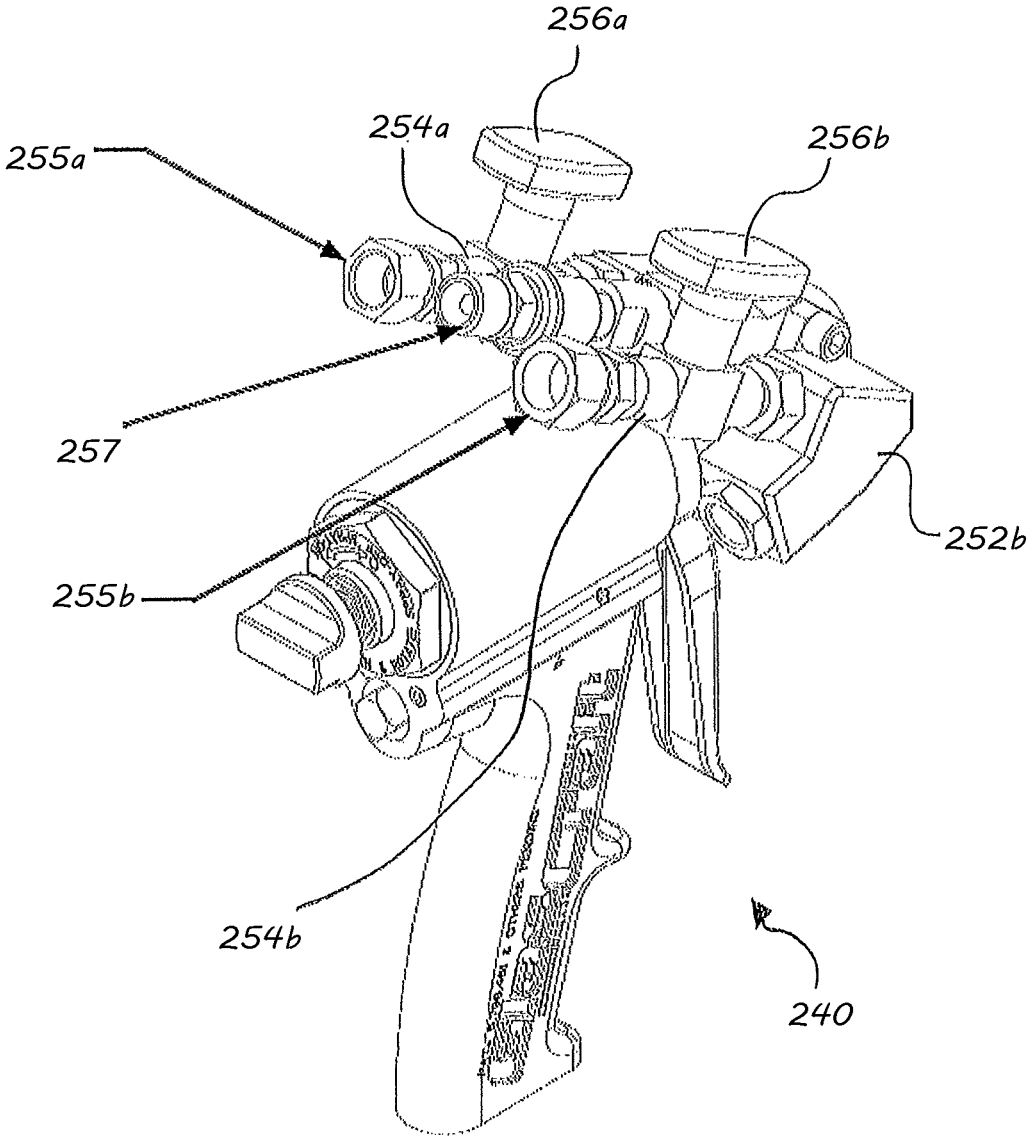
FIG. 7 (PRIOR ART)
FIG. 7 depicts a rear perspective view of the side block spray gun and side block spray gun manifold of FIG. 6.
Figure 8:
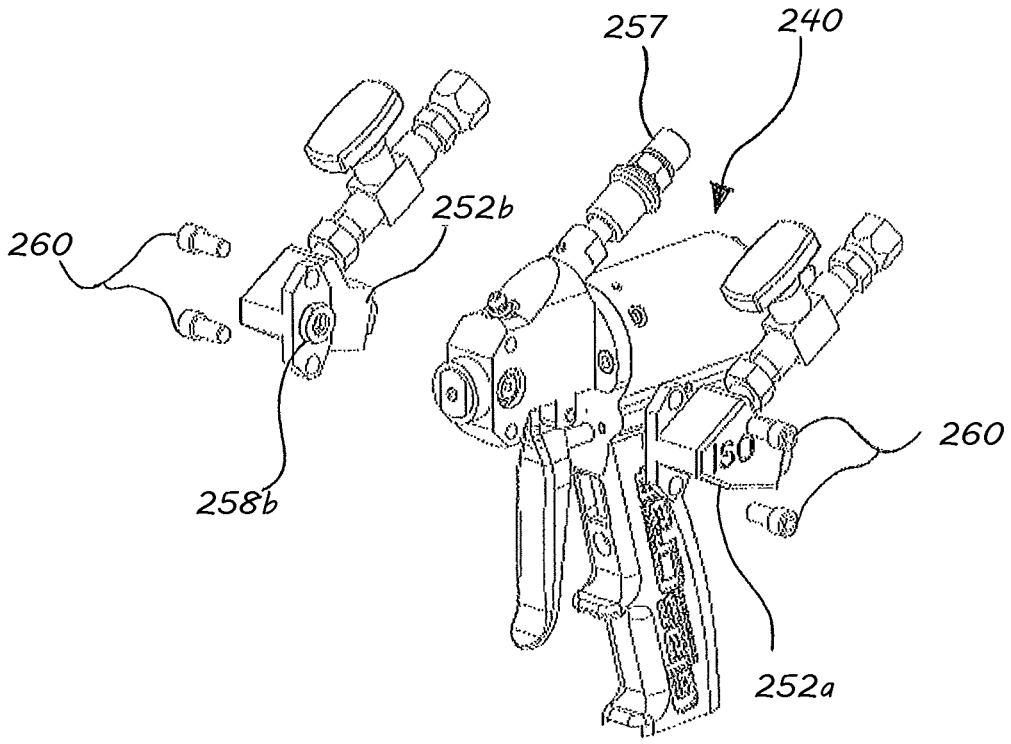
FIG. 8 (PRIOR ART)
FIG. 8 depicts an exploded assembly view of the side block spray gun and side block spray gun manifold of FIG. 6.
Figure 9:
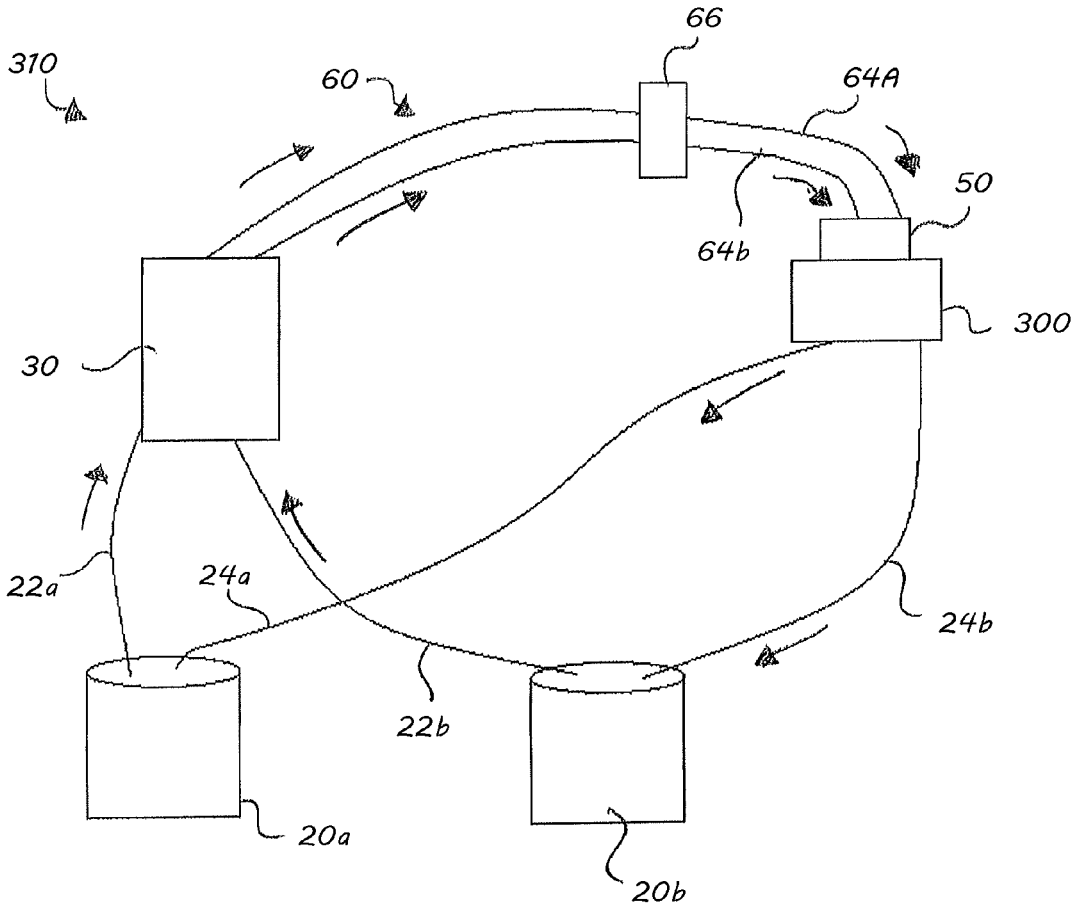
FIG. 9 (PRIOR ART)
FIG. 9 depicts a block diagram of an exemplary spray system where the spray gun has been replaced with a recirculation block.
Figure 10:
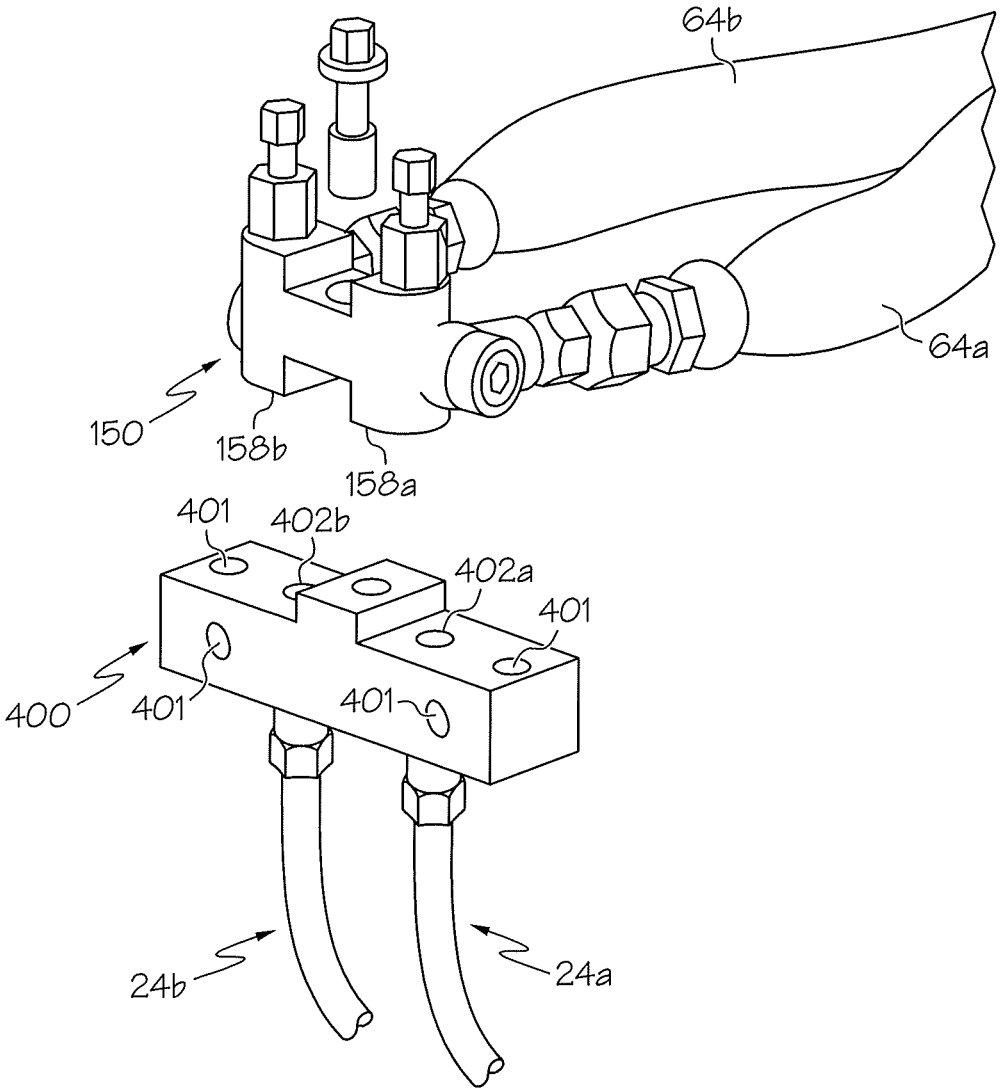
FIG. 10 (PRIOR ART)
FIG. 10 depicts a front perspective view of an exemplary prior art recirculation block configured to be used in conjunction with the junction block spray gun manifold of FIG. 4.
Figure 11:
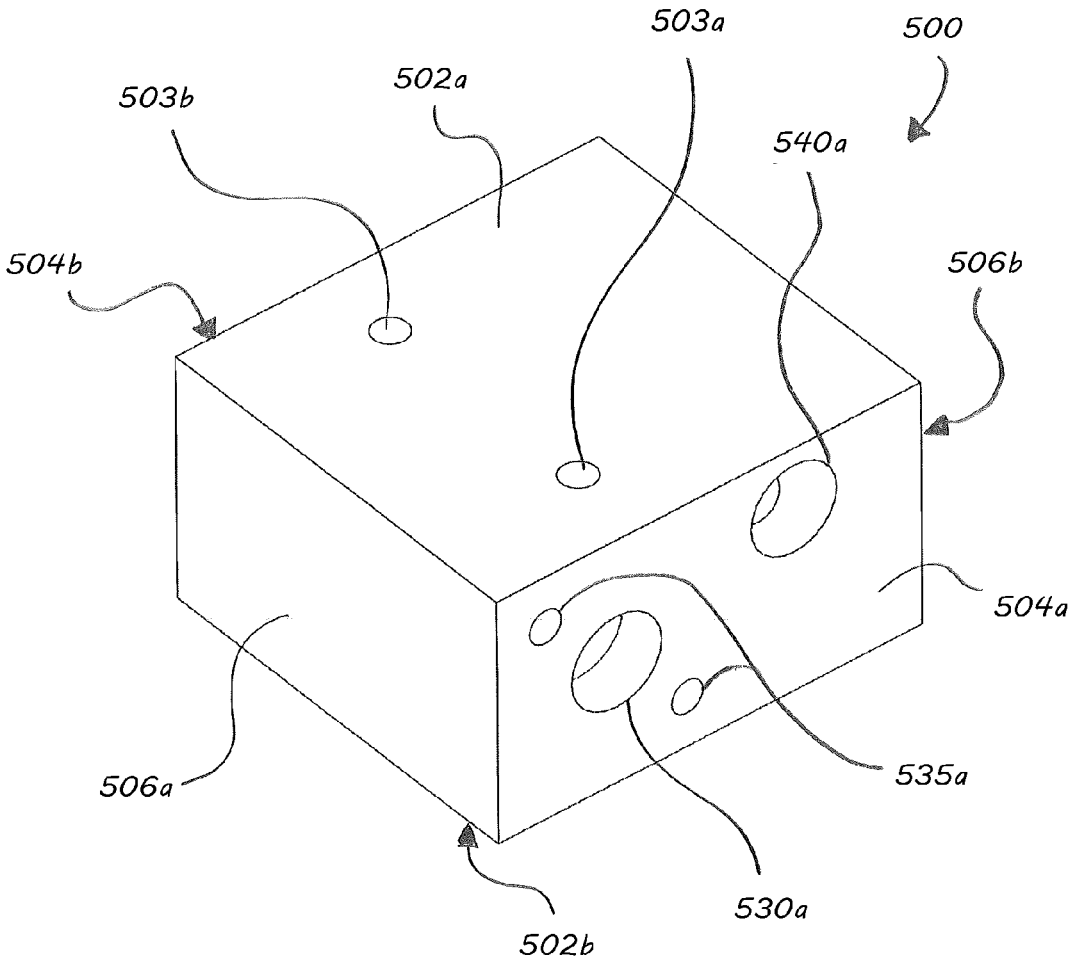
FIG. 11 depicts a front perspective view of an exemplary recirculation block.

The bottom face 502*b* further includes a manifold mount 524 positioned between junction block entry ports 520*a*, 520*b* that includes a fastening aperture 525. Manifold mount 524 and junction block fastening aperture 525 are configured to allow a junction block spray gun manifold, such as junction block spray gun manifold 150 described above, to be attached to recirculation block 500. Specifically, junction block fastening aperture 525 may be configured to receive any suitable fastener, including but not limited to a conventional fastener, such as the pin shown in FIG. 5.

As shown in FIGS. 11-15, recirculation block 500 further includes a pair of side block entry ports 530*a*, 530*b* positioned on the right side face 504*a* and left side face 504*b*, respectively, that are configured to be connected to a side block spray gun manifold (as described below). The right side face 504*a* further comprises a pair of side block fastening apertures 535*a* positioned obliquely relative to the central axis of side block entry port 530*a*. Similarly, the left side face 504*b* further comprises a pair of side block fastening apertures 535*b* positioned obliquely relative to the central axis of side block entry port 530*b*. Side block fastening apertures 535*a*, 535*b* are each configured to allow an individual side block, such as side block 252*a*, 252*b* described above, to be attached to recirculation block 500. Specifically, side block fastening apertures 535*a*, 535*b* may be configured to receive any suitable fastener, including but not limited to a conventional fastener, such as fasteners 260 described above. Side block fastening apertures 535*a*, 535*b* may be arranged in such a way so as to cause the side blocks 252*a*, 252*b* to be oriented at a desired angle relative to the horizontal axis of recirculation block 500 when they are attached to recirculation block 500. Having the side blocks 252*a*, 252*b* oriented at an angle relative to the horizontal axis of recirculation block 500 may prevent a tight radius from being applied to whip hoses 64*a*, 64*b*, which may reduce the stress on whip hoses 64*a*, 64*b* and reduce the risk of kinking the core of whip hoses 64*a*, 64*b*. By way of example only, side block fastening apertures may be arranged in such a way so as to cause side blocks 252*a*, 252*b* to be oriented at a 45 degree angle relative to the horizontal axis of recirculation block 500.

In the illustrated embodiment, recirculation block 500 also includes a pair of exit ports 540*a*, 540*b* positioned on the right side face 504*a* and left side face 504*b*, respectively. Exit ports 540*a*, 540*b* are configured to be connected to respective return fitting assembly 600*a*, 600*b*. Specifically, as shown in FIGS. 16-20, exit port 540*a* is connected to right side return fitting assembly 600*a*, and exit port 540*b* is connected to left side return fitting assembly 600*b*. Right side return fitting assembly 600*a* and left side return fitting assembly 600*b* will be described in more detail below.

Figure 12:
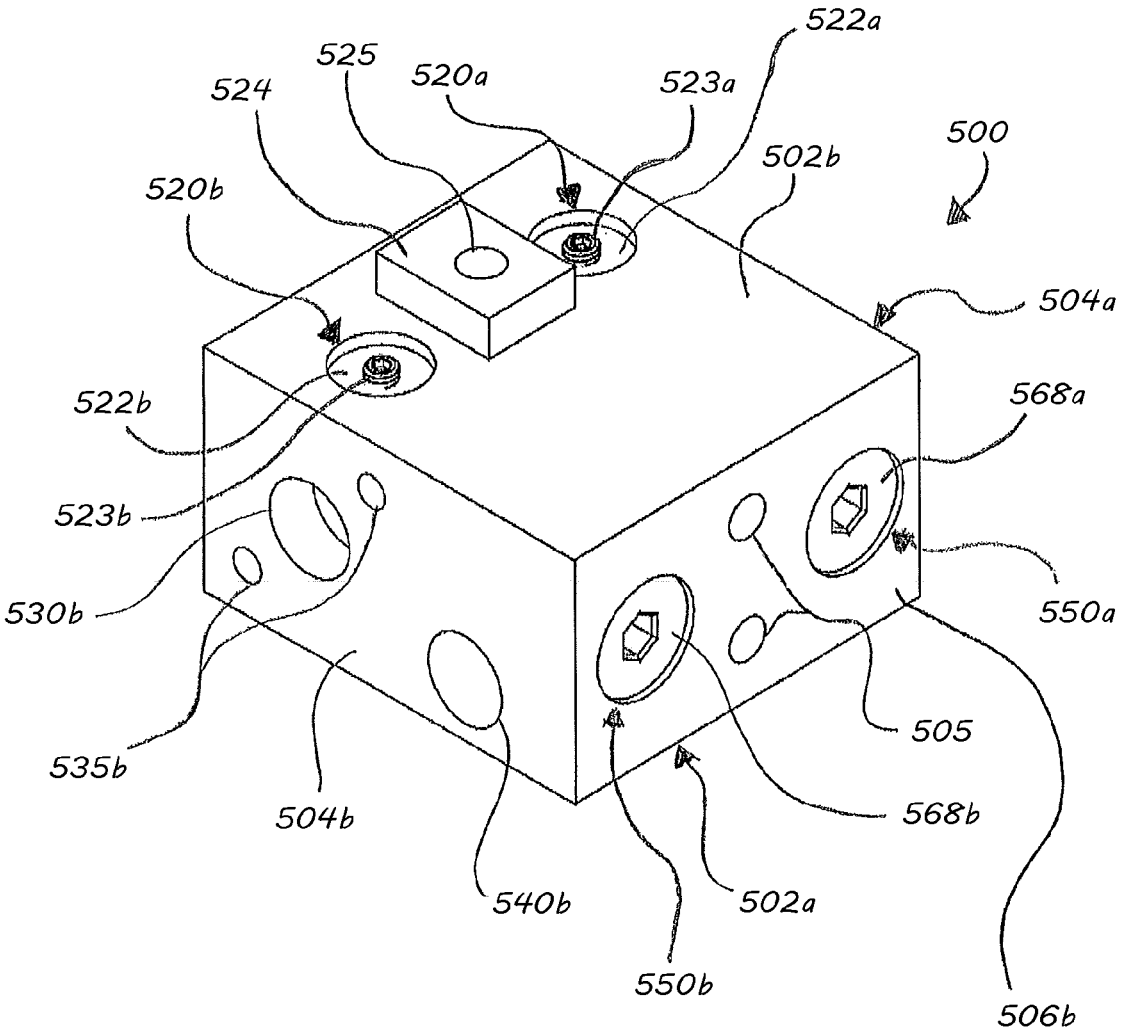
FIG. 12 depicts a rear perspective view of the recirculation block of FIG. 11.
Figure 13:
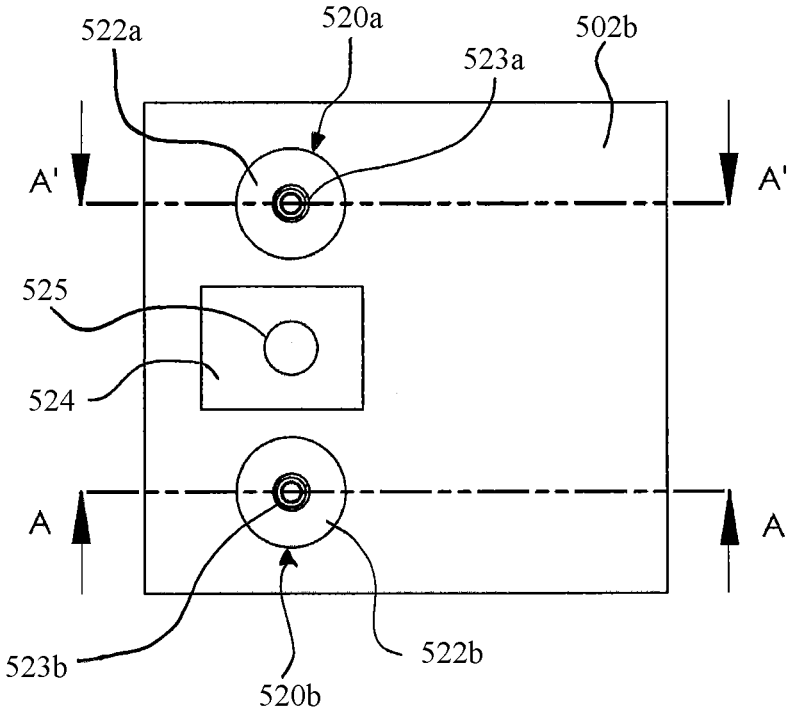
FIG. 13 depicts a bottom plan view of the recirculation block of FIG. 11.
Figure 18:
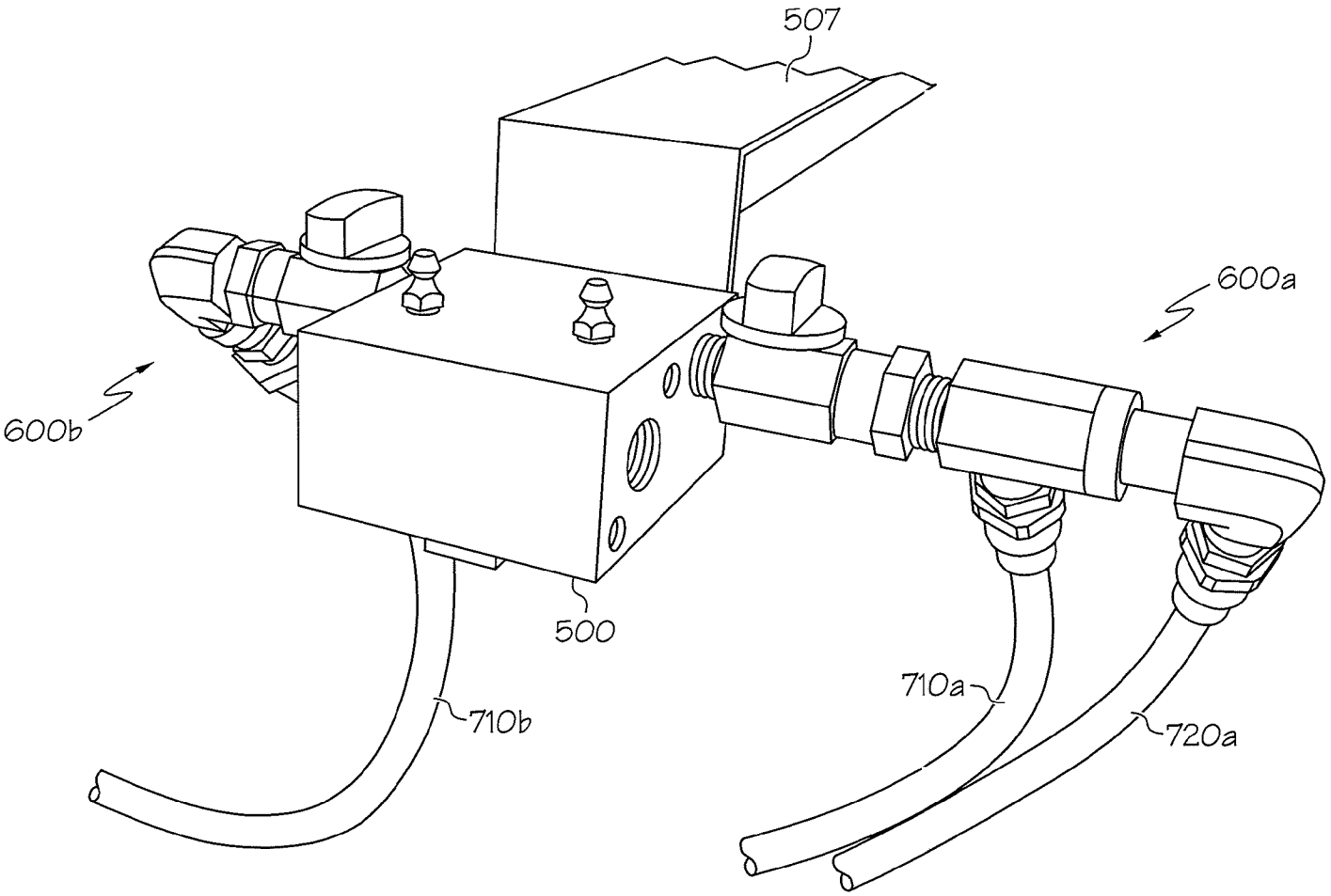
FIG. 18 depicts a front perspective view of the recirculation block assembly of FIG. 16 attached to a mounting structure with a piece of one of the return fitting assemblies removed.
Figure 19:
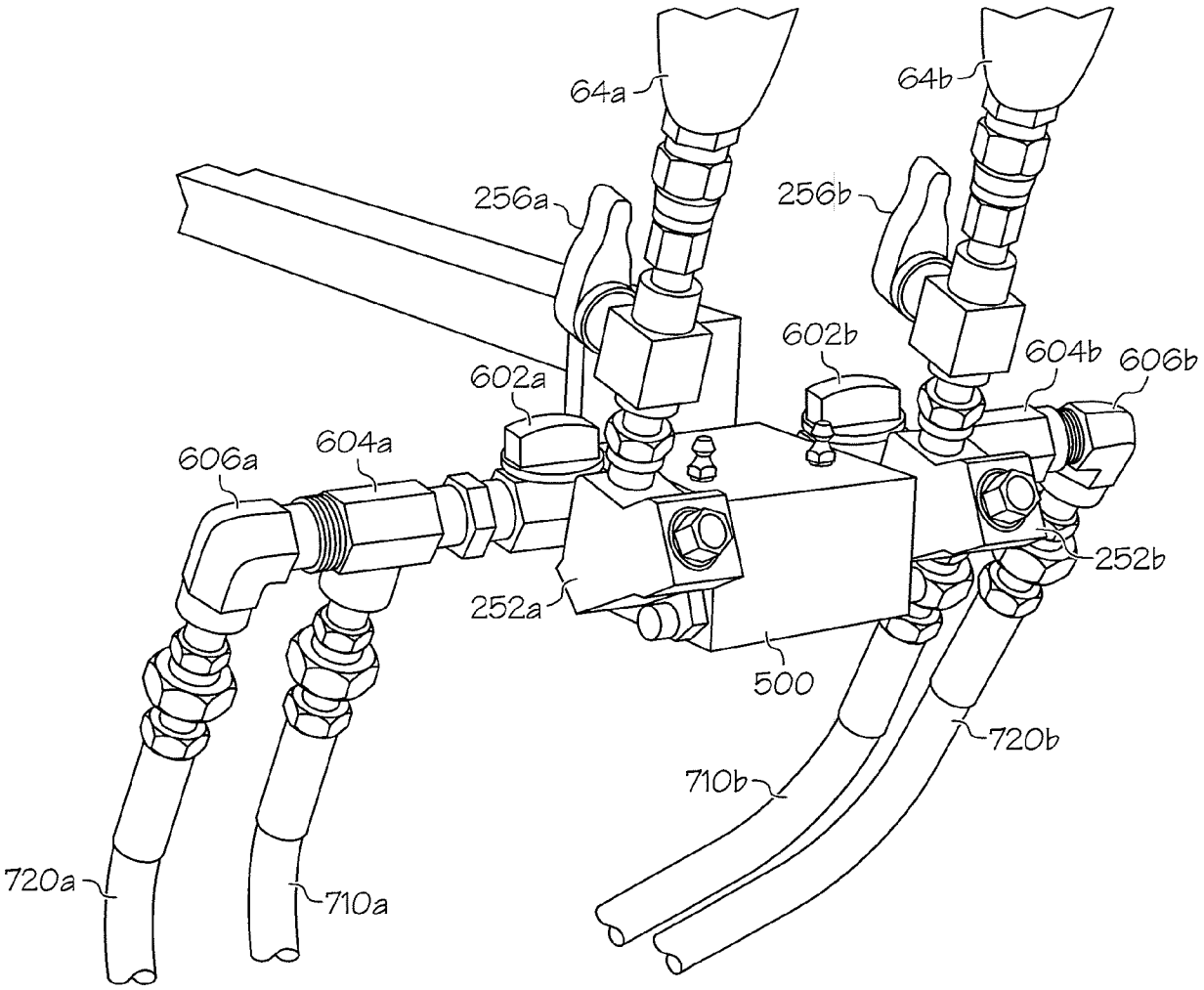
FIG. 19 depicts a front perspective view of the recirculation block assembly of FIG. 16 with an exemplary side block spray gun manifold comprising two individual side blocks connected to the recirculation block.
Figure 20:
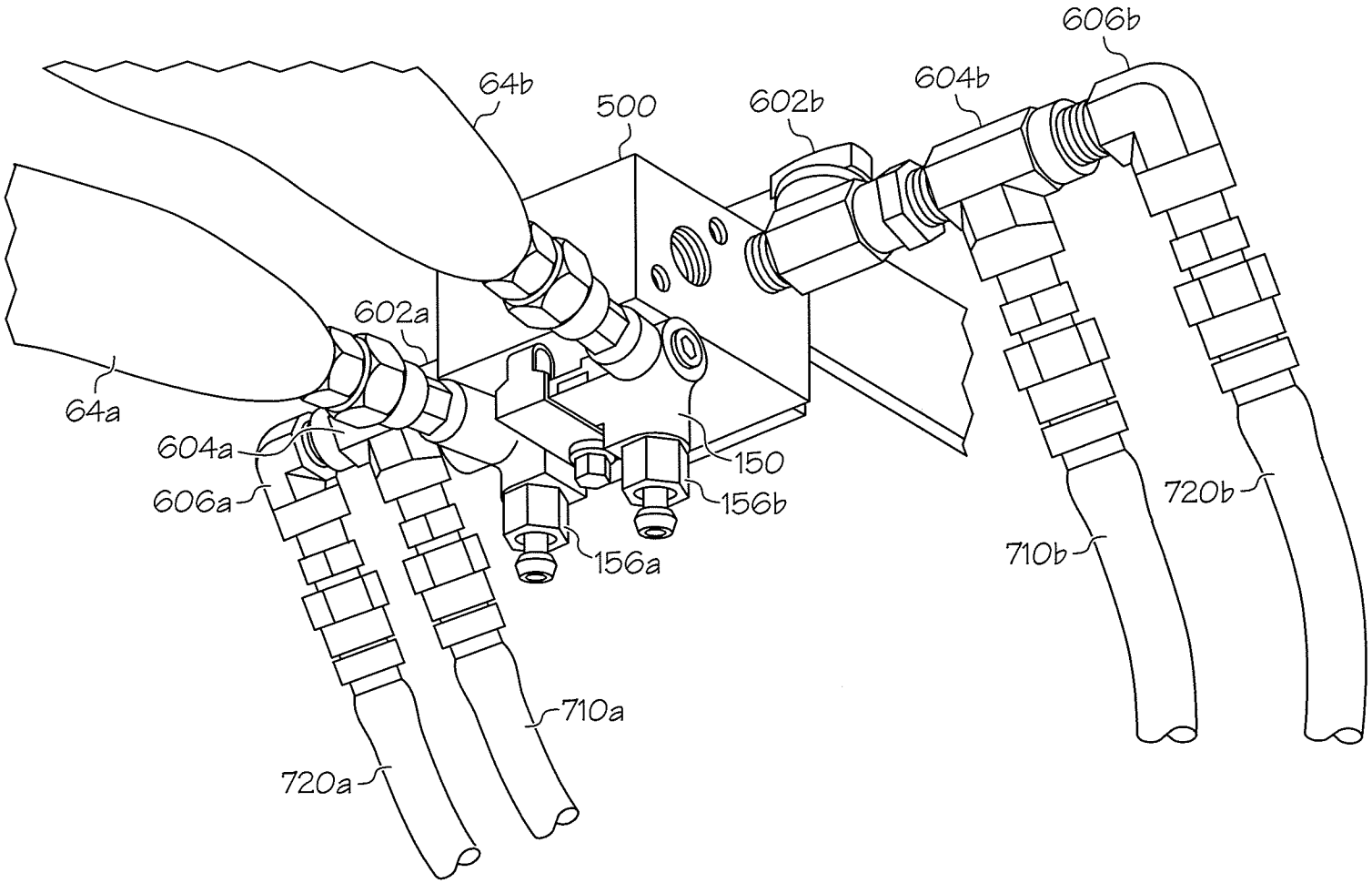
FIG. 20 depicts a front perspective view of the recirculation block assembly of FIG. 16 with an exemplary junction block spray gun manifold connected to the recirculation block.

The embodiment shown in FIGS. 11-15 also includes a pair of internal check valve openings 550*a*, 550*b* in rear face 506*b* that are configured to house a pair of internal check valves 560*a*, 560*b* (described in more detail below). As can be seen in FIG. 12, internal check valve openings 550*a*, 550*b* are sealed by a respective internal check valve plug 568*a*, 568*b*. Furthermore, recirculation block 500 also includes a pair of block mounting apertures 505 in rear face 506*b* that are configured to allow recirculation block 500 to be attached to a mounting structure in a desired location. Recirculation block 500 may be attached to a mounting structure using any suitable devices or methods configured to keep recirculation block 500 secure and stable, including but not limited to conventional fasteners in conjunction with block mounting apertures 505 or other methods or devices that do not require block mounting apertures, such as adhesives. FIGS. 18-20 depict mounting structure 507 comprising a mounting arm. Mounting structure 507 may be located at any suitable location, including but not limited to within a hose rack.

In the illustrated embodiment, each of the entry ports (junction block entry ports 520*a*, 520*b* and side block entry ports 530*a*, 530*b*) includes a port seal 522*a*, 522*b*, 532*a*, 532*b* positioned within each respective entry port 520*a*, 520*b*, 530*a*, 530*b*. Each port seal 522*a*, 522*b*, 532*a*, 532*b* may be configured to facilitate the connection of the applicable spray gun manifold to recirculation block 500 and to prevent leaks during recirculation. Port seals 522*a*, 522*b*, 532*a*, 532*b* may be soft seals, which are seals comprised of material having one or more of the following characteristics: low Shore D hardness, good elasticity, good flexibility, good chemical resistance, and good temperature stability. For example, port seals 522*a*, 522*b*, 532*a*, 532*b* may comprise material that has a Shore D hardness of about D50 or less, a tensile elongation at break of about 300% or more, and/or a maximum operating temperature of at least about 500° F. or at least about 260° C. In some embodiments, port seals 522*a*, 522*b*, 532*a*, 532*b* may comprise polytetrafluroethylene (PTFE), preferably Teflon® PTFE, and more preferably virgin Teflon® PTFE. Soft seals having one or more of the characteristics described above may provide benefits compared to traditional, hard seals or metal-on-metal seals, including providing superior sealing across a range of pressures compared to hard seals or metal-on-metal seals, particularly at lower pressures. Soft seals may also comprise material that has a low coefficient of friction to provide a slippery surface that facilitates cleaning of the seals. Port seals 522*a*, 522*b*, 532*a*, 532*b* are positioned with their respective entry ports 520*a*, 520*b*, 530*a*, 530*b* so that they provide a fluid-tight seal with the corresponding gun coupling (e.g., gun couplings 158*a*, 158*b* in junction block spray gun manifold 150 or the gun couplings on the individual side blocks 252*a*, 252*b* for side block spray gun manifold 250) when the selected spray gun manifold is connected to recirculation block 500, while still allowing the respective fluid component to flow through the selected spray gun manifold, into and through recirculation block 500. As illustrated by a comparison of FIGS. 14 and 15, in some embodiments, port seals 522*a*, 522*b* may comprise a different thickness relative to port seals 532*a*, 532*b*. In the illustrated embodiment, port seals 522*a*, 522*b* are thinner than port seals 532*a*, 532*b* due to the different forces being applied to each of those port seals 522*a*, 522*b*, 532*a*, 532*b* depending on which type of manifold is attached to the respective port seal 522*a*, 522*b*, 532*a*, 532*b*.

In a side block configuration, such as the one shown in FIGS. 12-16 and 19 where recirculation block 500 is configured to be connected to a side block spray gun manifold, such as individual side blocks 252*a*, 252*b* of side block spray gun manifold 250, port seals 522*a*, 522*b* positioned within junction block entry ports 520*a*, 520*b* respectively, are held in place and the central opening in each port seal 522*a*, 522*b* is sealed by a fastener, such as set screw 523*a*, 523*b*. In the side block configuration, the fasteners in the central opening in each port seal 532*a*, 532*b* are removed so that the central opening remains open to allow fluid components to flow through the side block spray gun manifold into recirculation block 500. In a junction block configuration, such as the one shown in FIG. 20 where recirculation block 500 is configured to be connected to a junction block spray gun manifold, such as junction block spray gun manifold 150, port seals 532*a*, 532*b* positioned within side block entry ports 530*a*, 530*b* respectively, are held in place and the central opening in each port seal 532*a*, 532*b* is sealed by a fastener, such as a set screw. In the junction block configuration, set screws 523*a*, 523*b* are removed so that the central opening in each port seal 522*a*, 522*b* remains open to allow fluid components to flow through the junction block spray gun manifold into recirculation block 500. As a result, a user can alternate recirculation block 500 between a side block configuration and a junction block configuration by inserting and removing the corresponding fasteners, such as threaded plugs or set screws 523*a*, 523*b*, in the appropriate port seals 522*a*, 522*b*, 532*a*, 532*b*.

Figure 14:
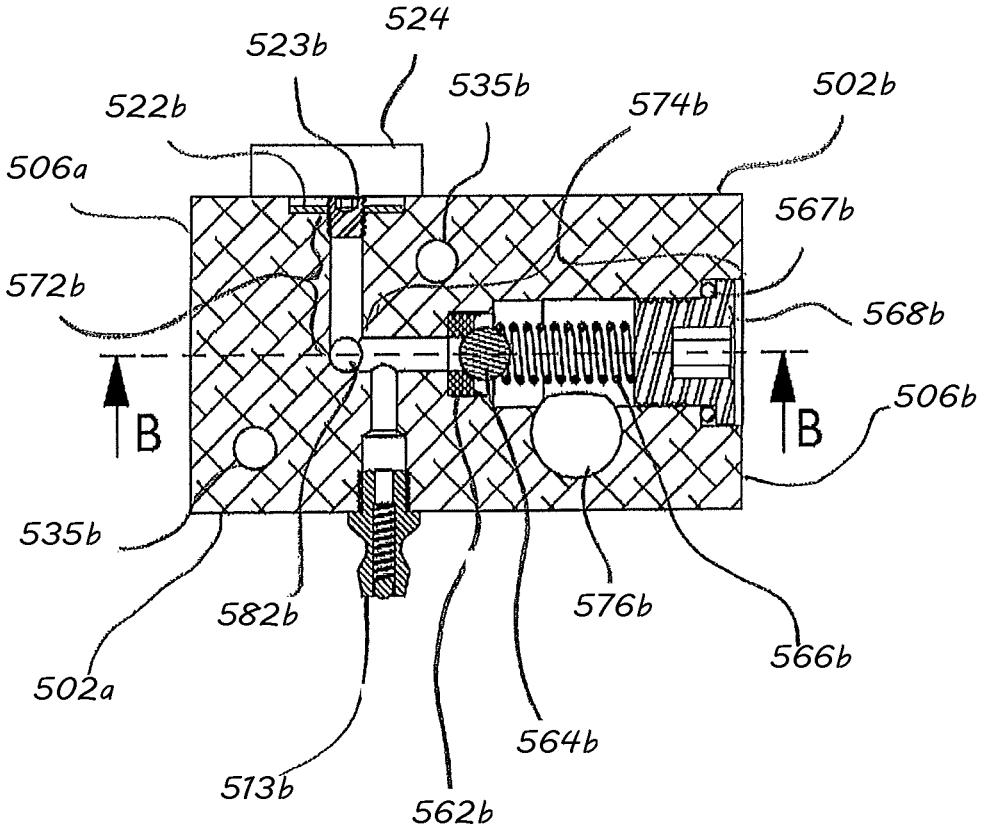
FIG. 14 depicts a side cross-sectional view of the recirculation block of FIG. 11 taken along line A-A in FIG. 13.
Figure 15:
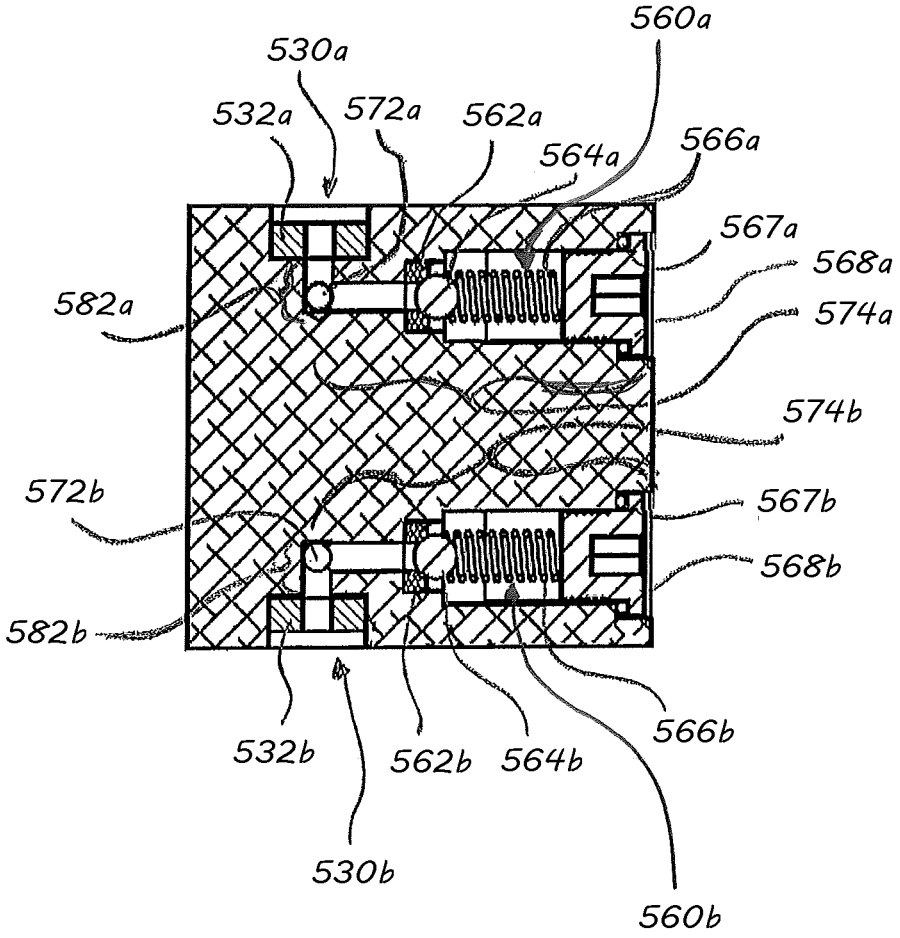
FIG. 15 depicts a top cross-sectional view of the recirculation block of FIG. 11 taken along line B-B in FIG. 14.
Figure 16:
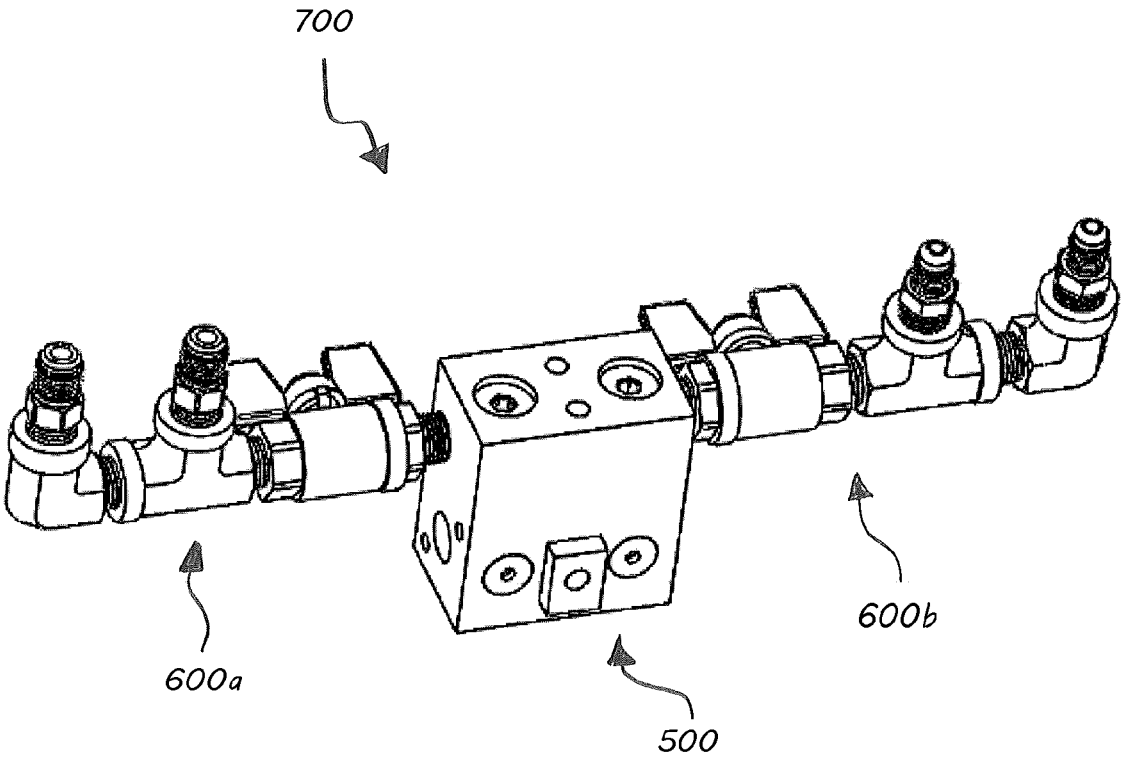
FIG. 16 depicts a rear perspective view of an exemplary recirculation block assembly that includes the recirculation block of FIG. 11 and a pair of exemplary return fitting assemblies.
Figure 17:
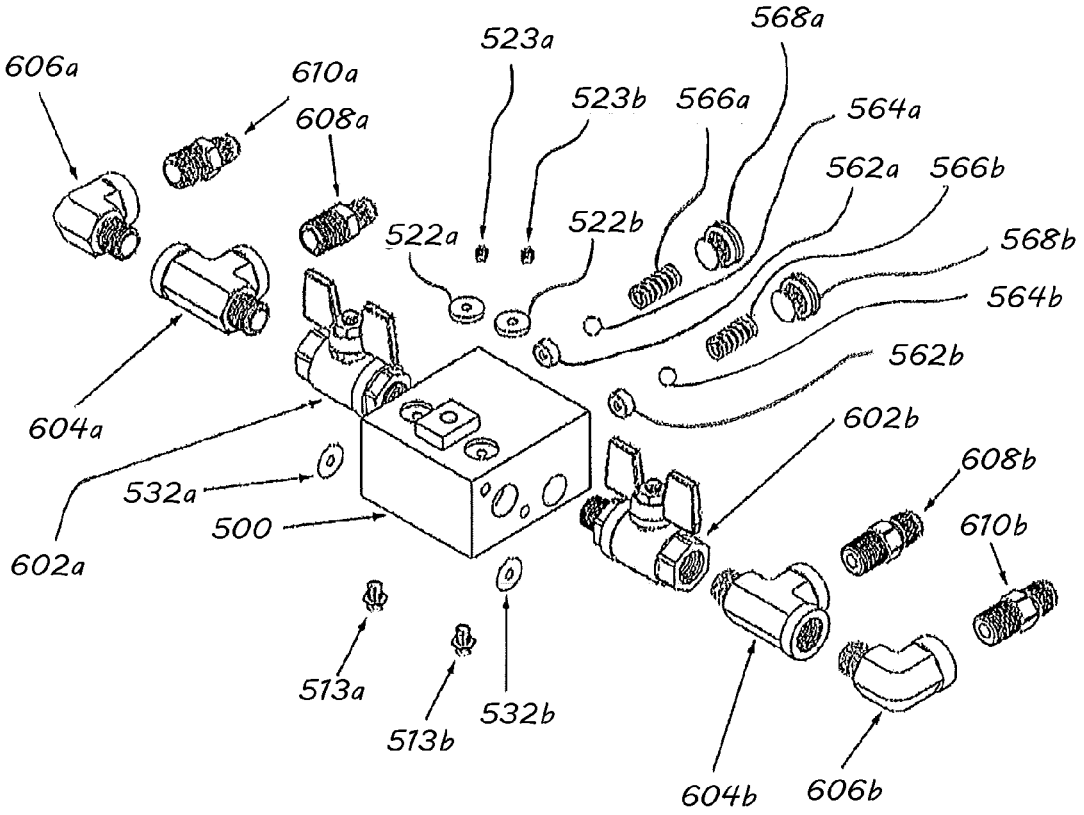
FIG. 17 depicts an exploded assembly view of the recirculation block assembly of FIG. 16.

As shown in FIGS. 14 and 15, recirculation block 500 includes a series of interconnected channels configured to allow fluid components to enter recirculation block 500 through an entry port 520*a*, 520*b*, 530*a*, 530*b*, flow through recirculation block 500 and exit recirculation block 500 through a corresponding exit port 540*a*, 540*b*. Specifically, in the illustrated embodiment, entry port 520*b* is in fluid communication with a junction block channel 572*b*, and junction block channel 572*b* is in fluid communication with an internal check valve channel 574*b*. As shown, internal check valve channel 574*b* is in fluid communication with an exit port channel 576*b*, which is in fluid communication with exit port 540*b*. Internal check valve channel 574*b* houses an internal check valve 560*b* configured to help prevent bleed back of the fluid components and to help prevent leaks associated with open ports or downstream valves being left open or failing.

As shown, internal check valve 560*b* comprises a seat 562*b*, a ball 564*b*, a spring 566*b*, and a plug 568*b*. In this embodiment, internal check valve 560*b* further comprises an o-ring 567*b* positioned around a portion of plug 568*b* to help seal internal check valve channel 574*b*. Seat 562*b*, ball 564*b*, spring 566*b*, and plug 568*b* are arranged longitudinally along a portion of internal check valve channel 574*b*. Seat 562*b* abuts a shoulder formed in internal check valve channel 574*b* and ball 564*b* is positioned adjacent to a central opening in seat 562*b*. Spring 566*b* is held in compression between ball 564*b* at a first end and a plug 568*b* at a second end such that ball 564*b* selectively seals the central opening in seat 562*b*. Internal check valve 560*b* is configured to allow a fluid component to flow at a predetermined pressure in the direction from entry port 520*b* or entry port 530*b* toward exit port 540*b* while also preventing a fluid component from flowing in the opposite direction regardless of the pressure. Specifically, when spring 566*b* is compressed, such as when a fluid component flows with enough pressure into internal check valve channel 574*b* from either junction block channel 572*b* or side block channel 582*b*, then ball 564*b* is forced away from seat 562*b* toward plug 568*b*, which allows the fluid component to flow through internal check valve channel 572*b* into exit port channel 576*b* and out exit port 540*b*. Accordingly, a fluid component can flow into recirculation block 500 via entry port 520*b*, flow through junction block channel 572*b* into internal check valve channel 574*b* and exit recirculation block 500 through exit port 540*b* via exit port channel 576*b*.

In some embodiments, seats 562*a*, 562*b* may comprise silicone having a high Shore A hardness. For example, the silicone may comprise a Shore A hardness of at least A70. Such a material may provide an improved seal over a wide range of chemicals and viscosities as compared to conventional metal seats or seals.

Figure 14A:
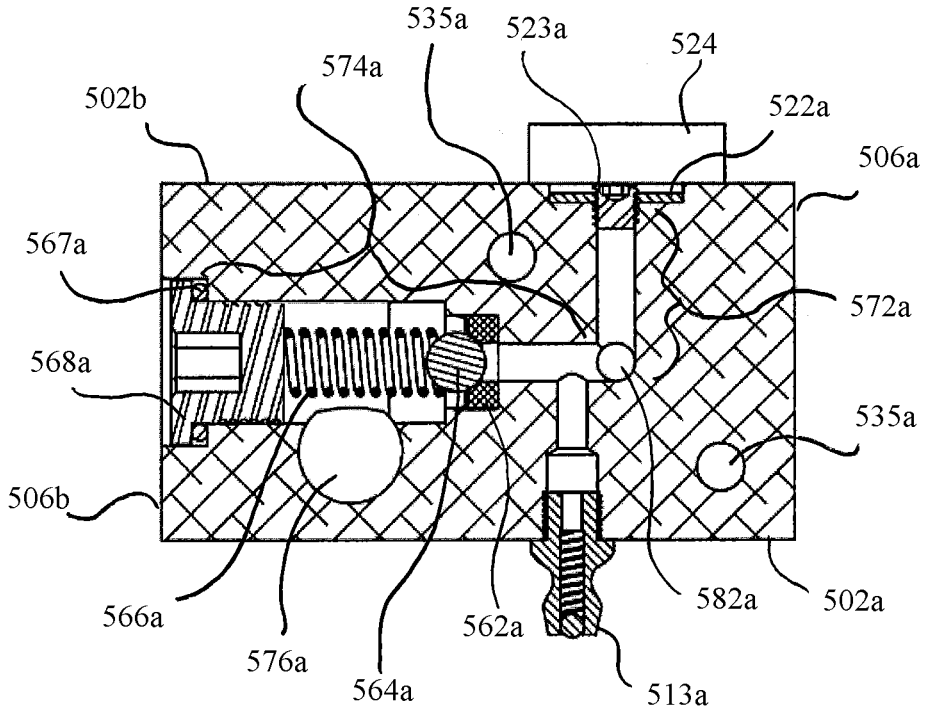
FIG. 14A depicts a side cross-sectional view of the recirculation block of FIG. 11 taken along line A'-A' in FIG. 13.

Entry port 520*a* is in fluid communication with a separate junction block channel 572*a* that is substantially identical to junction block channel 572*b*. In other words, entry port 520*a* and its associated junction block channel 572*a* are essentially a mirror image of entry port 522*a* and junction block channel 572*b*. Similarly, internal check valve channel 574*a* is in fluid communication with an exit port channel 576*a* that is in fluid communication with exit port 540*a*. The exit port channel 576*a* that is in fluid communication with exit port 540*a* is substantially identical to exit port channel 576*b*. In other words, internal check valve channel 574*a* and its associated exit port channel 576*a* are essentially a mirror image of internal check valve channel 574*b* and exit port channel 576*b*. The only differences are that the junction block channel 572*a* connected to entry port 520*a* is in fluid communication with internal check valve channel 574*a* shown in FIGS. 14A and 15 (instead of being in fluid communication with internal check valve channel 574*b*), which in turn is in fluid communication with the exit port channel 576*a* that is in fluid communication with exit port 540*a* (instead of being in fluid communication with exit port channel 576*b*). As a result, a fluid component can flow into recirculation block 500 via entry port 520*a*, flow through the connected junction block channel 572*a* into internal check valve channel 574*a*, and exit recirculation block 500 through exit port 540*a* via an exit port channel 576*a* between internal check valve channel 574*a* and exit port 540*a*.

As can be seen in FIG. 15, entry port 530*a* is in fluid communication with a side block channel 582*a*, and side block channel 582*a* is in fluid communication with an internal check valve channel 574*a*. As discussed above, internal check valve channel 574*a* is in fluid communication with an exit port channel 576*a* which is in fluid communication with exit port 540*a*. Internal check valve channel 574*a* houses an internal check valve 560*a* that is substantially identical to internal check valve 560*b* described above. As shown, internal check valve 560*a* comprises a seat 562*a*, a ball 564*a*, a spring 566*a*, a plug 568*a*, and an o-ring 567*a* positioned around a portion of plug 568*a* to help seal internal check valve channel 574*a*. These components of internal check valve 560*a* are arranged and function substantially identically to those of internal check valve 560*b* described above, and, for that reason, the description of the arrangement and function of those components will not be repeated. Accordingly, a fluid component can flow into recirculation block 500 via entry port 530*a*, flow through side block channel 582*a* into internal check valve channel 574*a* and exit recirculation block 500 through exit port 540*a* via an exit port channel 576*a* between internal check valve channel 574*a* and exit port 540*a*.

Similar to entry port 530*a* described above, entry port 530*b* is also in fluid communication with a side block channel 582*b*, and side block channel 582*b* is in fluid communication with internal check valve channel 574*b*, which is described above. The description of internal check valve channel 574*b* and internal check valve 560*b* will not be repeated. Accordingly, a fluid component can flow into recirculation block 500 via entry port 530*b*, flow through side block channel 582*b* into internal check valve channel 574*b* and exit recirculation block 500 through exit port 540*b* via exit port channel 576*b*.

As a result of the series of interconnected channels within recirculation block 500, a fluid component that enters recirculation block 500 through either entry port 520*a* or 530*a* is fed through internal check valve channel 574*a* and exits recirculation block 500 through exit port 540*a*. Alternatively, a fluid component that enters recirculation block 500 through either entry port 520*b* or 530*b* is fed through internal check valve channel 574*b* and exits recirculation block 500 through exit port 540*b*. Accordingly, the exit ports 540*a*, 540*b* and the corresponding return fitting assemblies 600*a*,

600*b* do not need to be manipulated or altered by the user based on which type of spray gun manifold is connected to recirculation block 500.

FIGS. 16-20 illustrate a recirculation block assembly 700 comprising recirculation block 500 and return fitting assemblies 600*a*, 600*b*. In this embodiment, return fitting assembly 600*a* is connected to recirculation block 500 via exit port 540*a* in such a way so as to allow fluid components to flow through recirculation block 500 into return fitting assembly 600*a*. Similarly, return fitting assembly 600*b* is connected to recirculation block 500 via exit port 540*b* in such a way as to allow fluid components to flow through recirculation block 500 into return fitting assembly 600*b*.

As shown in FIGS. 16-17 and 19-20, return fitting assembly 600*a* includes an external check valve 602*a*, a tee fitting 604*a*, and an elbow fitting 606*a*. Return fitting assembly 600*a* also includes a first circulation line connector 608*a* engaged with tee fitting 604*a* and a second circulation line connector 610*a* engaged with elbow fitting 606*a*. First circulation line connector 608*a* and second circulation line connector 610*a* are each configured to allow a circulation line to be connected to return fitting assembly 600*a* to complete the recirculation circuit and return the fluid component to the appropriate storage tank. Similarly, as shown in FIGS. 16-17 and 19-20, return fitting assembly 600*b* includes an external check valve 602*b*, a tee fitting 604*b*, and an elbow fitting 606*b*. Return fitting assembly 600*b* also includes a first circulation line connector 608*b* engaged with tee fitting 604*b* and a second circulation line connector 610*b* engaged with elbow fitting 606*b*. First circulation line connector 608*b* and second circulation line connector 610*b* are each configured to allow a circulation line to be connected to return fitting assembly 600*b* to complete the recirculation circuit and return the fluid component to the appropriate storage tank.

The inclusion of both tee fitting 604*a*, 604*b* and elbow fitting 606*a*, 606*b* in each return fitting assembly 600*a*, 600*b* allows for two circulation lines to be connected to each return fitting assembly 600*a*, 600*b*. It will be appreciated that, in other embodiments, additional tee fittings may be added in order to allow for the connection of additional circulation lines. Alternatively, in other embodiments, tee fittings 604*a*, 604*b* may be omitted entirely, and elbow fittings 606*a*, 606*b* may be connected directly to a respective external check valve 602*a*, 602*b*, resulting in a single circulation line being connected to each return fitting assembly 600*a*, 600*b*. Although return fitting assemblies 600*a*, 600*b* are substantially identical to each other in the embodiment shown in FIGS. 16-17 and 19-20, it will be appreciated that this is not required. In other embodiments, one return fitting assembly 600*a*, 600*b* may include a tee fitting 604*a*, 604*b* while the other return fitting assembly 600*a*, 600*b* does not include a tee fitting 604*a*, 604*b*. By way of example only, FIG. 18 depicts an embodiment where one return fitting assembly includes a tee fitting and an elbow fitting, which allows for two circulation lines to connected, while the other return fitting assembly does not include a tee fitting, which allows for one circulation line to be connected. Accordingly, the particular number of circulation lines connected to the return fitting assemblies 600*a*, 600*b* may vary depending on the specific requirements of a particular application.

In this embodiment, external check valves 602*a*, 602*b* are configured to selectively allow or prevent fluid components to flow from recirculation block 500 through the respective return fitting assembly 600*a*, 600*b* into connected circulation lines, such as circulation lines 710*a*, 710*b* shown in FIGS. 18, 19 and 20. In one embodiment external check valves 602*a*, 602*b* comprise butterfly valves configured to be selectively opened and closed via manual operation of a valve handle 603*a*, 603*b*. In the illustrated embodiment, external check valves 602*a*, 602*b* provide a component capable of controlling the flow of fluid components in addition to, but separate from, internal check valves 560*a*, 560*b*. External check valves 602*a*, 602*b* may comprise positive shutoff valves that are configured to provide positive closure of their respective return fitting assembly 600*a*, 600*b* to prevent fluid from flowing from recirculation block 500 through the respective return fitting assembly 600*a*, 600*b*. External check valves 602*a*, 602*b* may comprise any suitable type of shutoff valve, including but not limited to manually actuated, power-actuated or spring-actuated shutoff valves. Use of a manually actuated, power-actuated, or spring-actuated positive shutoff valve for external check valves 602*a*, 602*b* may reduce the risk of a leak by providing a positive and verifiable closure of the respective return fitting assembly 600*a*, 600*b*.

FIG. 18 depicts an embodiment wherein recirculation block 500 is attached to a mounting structure 507 without having a spray gun manifold connected to recirculation block 500. As shown in FIG. 18, return fitting assembly 600*a* includes external check valve 602*a*, tee fitting 604*a*, and elbow fitting 606*a*, and return fitting assembly 600*b* includes external check valve 602*b* and elbow fitting 606*b*. Circulation lines 710*a*, 720*a* are connected to tee fitting 604*a* and elbow fitting 606*a* respectively in the illustrated embodiment. In addition, in this embodiment, circulation line 710*b* is connected to elbow fitting 606*b*. At least one circulation line connected to return fitting assembly 600*a* (e.g., circulation line 710*a*) is in fluid communication with a storage tank, such as storage tanks 20*a*, 20*b*, so that the fluid component returns to the appropriate storage tank after being circulated through recirculation block 500. In some embodiments at least one circulation line connected to return fitting assembly 600*a* (e.g., circulation line 720*a*) may be in fluid communication with a proportioner, such as proportioner 30, instead of being directly connected to a storage tank. In addition, in the embodiment shown in FIG. 18, circulation line 710*b* is connected to return fitting assembly 600*b* via elbow fitting 606*b*. Circulation line 710*b* is also in fluid communication with the appropriate storage tank, such as storage tanks 20*a*, 20*b*.

In the embodiment shown in FIG. 18, a fluid component may flow from the proportioner, such as proportioner 30, through circulation line 720*a* into return fitting assembly 600*a*. If the fluid component is also being circulated through recirculation block 500 and external check valve 602*a* is open, then the fluid component being circulated through recirculation block 500 and the fluid component flowing from the proportioner through circulation line 720*a* will both flow into tee fitting 604*a* and subsequently exit tee fitting 604*a* by flowing into circulation line 710*a*. Alternatively, if the fluid component is not being circulated through recirculation block 500 and external check valve 602*a* is closed, then the fluid component may flow from the proportioner through circulation line 720*a* into tee fitting 604*a* and subsequently exit tee fitting 604*a* by flowing into circulation line 710*a*.

In some embodiments, one or both of circulation lines 710*a*, 710*b* may be in fluid communication with an auxiliary tee fitting (not shown) located at the proportioner, such as proportioner 30, and the auxiliary tee fitting may be in communication with a first auxiliary circulation line that is in communication with the proportioner and a second auxiliary circulation line that is in communication with an appropriate storage tank, such as storage tanks 20*a*, 20*b*. Use of such an auxiliary tee fitting allows a first portion of the fluid component flowing through the respective circulation line 710*a*, 710*b* to be delivered to the proportioner and a second portion of the fluid component flowing through the respective circulation line 710*a*, 710*b* to be delivered back to the appropriate storage tank.

FIG. 19 depicts an embodiment where recirculation block 500 is being used in conjunction with a side block spray gun manifold, such as side block spray gun manifold 250. As shown, individual side blocks 252*a*, 252*b* are connected to recirculation block 500 via side block entry ports 530*a*, 530*b*, respectively. In this configuration, junction block entry ports 520*a*, 520*b* may be sealed by placing a fastener, such as set screw 523*a*, 523*b*, in the central opening of port seals 522*a*, 522*b* positioned within junction block entry ports 520*a*, 520*b*, respectively. In addition, whip hoses 64*a*, 64*b* are connected to side blocks 252*a*, 252*b*, respectively, as described above. Furthermore, in this embodiment, return fitting assemblies 600*a*, 600*b* are also connected to recirculation block 500. Return fitting assembly 600*a* includes external check valve 602*a*, tee fitting 604*a*, and elbow fitting 606*a*, and return fitting assembly 600*b* includes external check valve 602*b*, tee fitting 604*b*, and elbow fitting 606*b*.

In addition, as shown in FIG. 19, circulation lines 710*a*, 710*b* are connected to tee fittings 604*a*, 604*b*, respectively, and circulation lines 720*a*, 720*b* are connected to elbow fittings 606*a*, 606*b*, respectively. At least one circulation line connected to return fitting assembly 600*a* (e.g., circulation line 710*a*) is in fluid communication with a storage tank, such as storage tanks 20*a*, 20*b*, so that the fluid component provided through whip hose 64*a* can be returned to its respective storage tank after being recirculated. Similarly, at least one circulation line connected to return fitting assembly 600*b* (e.g., circulation line 710*b*) is in fluid communication with a storage tank, such as storage tanks 20*a*, 20*b*, so that the fluid component provided through whip hose 64*b* can be returned to its respective storage tank after being recirculated. In order to allow the fluid components to flow from the respective whip hose 64*a*, 64*b*, through recirculation block 500 and into the circulation lines 710*a*, 710*b* both the manifold valves 256*a*, 256*b* and the external check valves 602*a*, 602*b* should be manipulated to an open position (i.e., the position where they allow the fluid components to flow through those particular components). If the user wants to stop the recirculation process, then either or both of the manifold valves 256*a*, 256*b* and the external check valves 602*a*, 602*b* can be manipulated to a closed position (i.e., the position where they prevent the fluid components from flowing through those particular valves).

As discussed above with respect to FIG. 18, circulation lines 720*a*, 720*b* shown in FIG. 19 may be used to facilitate recirculation of a fluid component. Specifically, in the embodiment shown in FIG. 19, a fluid component may flow from the proportioner, such as proportioner 30, through circulation line 720*a*, 720*b* into a respective return fitting assembly 600*a*, 600*b*. If the fluid component is also being circulated through recirculation block 500 and the respective external check valve 602*a*, 602*b* is open, then the fluid component being circulated through recirculation block 500 and the fluid component flowing from the proportioner through circulation line 720*a*, 720*b* will both flow into the respective tee fitting 604*a*, 604*b* and subsequently exit the respective tee fitting 604*a*, 604*b* by flowing into the respective circulation line 710*a*, 710*b*. Alternatively, if the fluid component is not being circulated through recirculation block 500 and the respective external check valve 602*a*, 602*b* is closed, then the fluid component may flow from the proportioner through circulation line 720*a*, 720*b* into the respective tee fitting 604*a*, 604*b* and subsequently exit the respective tee fitting 604*a*, 604*b* by flowing into the respective circulation line 710*a*, 710*b*.

In addition, as also discussed above with respect to FIG. 18, in some embodiments one or both of circulation lines 710*a*, 710*b* shown in FIG. 19 may be in fluid communication with an auxiliary tee fitting (not shown) located at the proportioner, such as proportioner 30. The auxiliary tee fitting may be in communication with a first auxiliary circulation line that is in communication with the proportioner and a second auxiliary circulation line that is in communication with an appropriate storage tank, such as storage tanks 20*a*, 20*b*. Use of such an auxiliary tee fitting allows a first portion of the fluid component flowing through the respective circulation line 710*a*, 710*b* to be delivered to the proportioner and a second portion of the fluid component flowing through the respective circulation line 710*a*, 710*b* to be delivered back to the appropriate storage tank.

FIG. 20 depicts an embodiment where recirculation block 500 is being used in conjunction with a junction block spray gun manifold, such as side block spray gun manifold 150. As shown, junction block 150 is connected to recirculation block 500 via junction block entry ports 520*a*, 520*b*, respectively. In this configuration, side block entry ports 530*a*, 530*b* may be sealed by placing a fastener, such as a set screw, in the central opening of port seals 532*a*, 532*b* positioned within side block entry ports 530*a*, 530*b*, respectively. In addition, whip hoses 64*a*, 64*b* are connected to junction block 150, as described above.

Furthermore, in this embodiment, return fitting assemblies 600*a*, 600*b* are also connected to recirculation block 500. Return fitting assembly 600*a* includes external check valve 602*a*, tee fitting 604*a*, and elbow fitting 606*a*, while return fitting assembly 600*b* includes external check valve 602*b*, tee fitting 604*b*, and elbow fitting 606*b*. In addition, as shown in FIG. 20, circulation lines 710*a*, 710*b* are connected to tee fittings 604*a*, 604*b*, respectively, and circulation lines 720*a*, 720*b* are connected to elbow fittings 606*a*, 606*b*, respectively. At least one circulation line connected to return fitting assembly 600*a* (e.g., circulation line 710*a*) is in fluid communication with a storage tank, such as storage tanks 20*a*, 20*b*, so that the fluid component provided through whip hose 64*a* can be returned to its respective storage tank after being recirculated. Similarly, at least one circulation line connected to return fitting assembly 600*b* (e.g., circulation line 710*b*) is in fluid communication with a storage tank, such as storage tanks 20*a*, 20*b*, so that the fluid component provided through whip hose 64*b* can be returned to its respective storage tank after being recirculated. In order to allow the fluid components to flow from the respective whip hose 64*a*, 64*b*, through recirculation block 500 and into the circulation lines 710*a*, 710*b*, both the manifold valves 156*a*, 156*b* and the external check valves 602*a*, 602*b* should be manipulated to an open position. If the user wants to stop the recirculation process, then either or both of the manifold valves 156*a*, 156*b* and the external check valves 602*a*, 602*b* can be manipulated to a closed position.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of any claims that may be presented and is understood not to be limited to the details of structure and operation shown and described in the specification and drawings.

What is claimed is:

1. A recirculation block comprising a first junction block entry port and a second junction block entry port;

a first side block entry port and a second side block entry port; and a first exit port and a second exit port, wherein the first exit port is in fluid communication with both the first junction block entry port and the first side block entry port, and wherein the second exit port is in fluid communication with both the second junction block entry port and the second side block entry port.

2. The recirculation block of claim 1, further comprising a manifold mount positioned adjacent to the first junction block entry port, wherein the manifold mount is selectively couplable with a spray gun manifold.

3. The recirculation block of claim 1, wherein the first junction block entry port and the second junction block entry port are defined by a first face of the recirculation block, wherein the first side block entry port is defined by a second face of the recirculation block, and wherein the second side block entry port is defined by a third face of the recirculation block.

4. The recirculation block of claim 3, further comprising a first pair of block fastening apertures defined by the second face and a second pair of block fastening apertures defined by the third face, wherein the first pair of block fastening apertures is selectively couplable with a first side block and the second pair of block fastening apertures is selectively couplable with a second side block.

5. The recirculation block of claim 4, wherein the first pair of block fastening apertures are positioned obliquely relative to a central axis of the first side block entry port, wherein the second pair of block fastening apertures are positioned obliquely relative to a central axis of the second side block entry port.

6. The recirculation block of claim 1, further comprising a face defining at least one lubrication aperture.

7. The recirculation block of claim 6, further comprising at least one zerk fitting inserted within the at least one lubrication aperture.

8. The recirculation block of claim 1, wherein the first junction block entry port, the second junction block entry port, the first side block entry port, and the second side block entry port each comprise a respective port seal positioned within the respective entry port.

9. The recirculation block of claim 8, wherein at least one of the respective port seals comprises a soft seal.

10. The recirculation block of claim 1, further comprising a pair of fasteners selectively couplable with each side block entry port to selectively seal each side block entry port, wherein the fasteners are coupled with the side block entry ports when fluid is flowing through the junction block entry ports.

11. The recirculation block of claim 1, further comprising a pair of fasteners selectively couplable with each junction block entry port to selectively seal each junction block entry port, wherein the fasteners are coupled with the junction block entry ports when fluid is flowing through the side block entry ports.

12. The recirculation block of claim 1, further comprising a first internal check valve and a second internal check valve, wherein the first internal check valve is positioned downstream of the first junction block entry port and the first side block entry port and upstream of the first exit port, and wherein the second internal check valve is positioned downstream of the second junction block entry port and the second side block entry port and upstream of the second exit port.

13. The recirculation block of claim 12, wherein the first internal check valve comprises:

a seat, wherein the seat comprises a central opening;

a ball positioned adjacent to the central opening of the seat;

a plug; and a spring held in compression between the ball at a first end and the plug at a second end such that the ball selectively seals the central opening of the seat.

14. The recirculation block of claim 13, wherein the seat comprises silicone.

15. A recirculation block comprising a top face and a bottom face that are connected by a right side face, a left side face, a front face, and a rear face;

a first junction block entry port and a second junction block entry port, wherein the first junction block entry port and the second junction block entry port are defined by the bottom face;

a first side block entry port and a second side block entry port, wherein the first side block entry port is defined by the right side face, and the second side block entry port is defined by the left side face; and a first exit port and a second exit port, wherein the first exit port is in fluid communication with both the first junction block entry port and the first side block entry port, and wherein the second exit port is in fluid communication with both the second junction block entry port and the second side block entry port.

16. The recirculation block of claim 15, further comprising a first internal check valve and a second internal check valve, wherein the first internal check valve is positioned within a first channel that is in fluid communication with the first junction block entry port and the first side block entry port, wherein the second internal check valve is positioned within a second channel that is in fluid communication with the second junction block entry port and the second side block entry port.

17. A recirculation block for recirculating fluid within a spray system, the recirculation block comprising:

a first junction block entry port;

a first side block entry port;

a first exit port;

a first internal check valve; and a first series of interconnected channels comprising a first junction block entry channel in fluid communication with the first junction block entry port, a first side block entry channel in fluid communication with the first side block entry port, an internal check valve channel in fluid communication with both the first junction block entry channel and the first side block entry channel, and an exit port channel in fluid communication with both the internal check valve channel and the first exit port; and wherein the first internal check valve is positioned within the internal check valve channel to selectively allow fluid to flow from either the first junction block entry port or the first side block entry port to the first exit port.

18. The recirculation block of claim 17, further comprising a face defining a first lubrication aperture in fluid communication with the first series of interconnected channels.

19. The recirculation block of claim 18, further comprising a first lube fitting positioned within the first lubrication aperture.

20. The recirculation block of claim 17, further comprising:

a second junction block entry port;

a second side block entry port;

a second exit port;

a second internal check valve; and a second series of interconnected channels comprising a second junction block entry channel in fluid communication with the second junction block entry port, a second side block entry channel in fluid communication with the second side block entry port, a second internal check valve channel in fluid communication with both the second junction block entry channel and the second side block entry channel, and a second exit port channel in fluid communication with both the second internal check valve channel and the second exit port; and wherein the second internal check valve is positioned within the second internal check valve channel to selectively allow fluid to flow from either the second junction block entry port or the second side block entry port to the second exit port.

* * * * *